US005745089A

United States Patent [19]

Taguchi et al.

[11] Patent Number: 5,745,089

[45] Date of Patent: Apr. 28, 1998

[54] METHOD FOR DRIVING APPARATUS

[75] Inventors: Jun'ichi Taguchi, Sagamihara; Hiroyuki Mano, Chigasaki; Toshio Tanaka; Koichi Sano, both of Yokohama; Shigeyuki Nishitani, Ebina, all of Japan

[73] Assignee: Hitachi, Ltd., Tokyo, Japan

[21] Appl. No.: 120,551

[22] Filed: Sep. 14, 1993

[30] Foreign Application Priority Data

Sep. 14, 1992 [JP] Japan ..... 4-244511
Dec. 7, 1992 [JP] Japan ..... 4-326434

[51] Int. Cl.[6] ..... G09G 3/36

[52] U.S. Cl. ..... 345/89; 345/94

[58] Field of Search ..... 345/63, 89, 87, 345/94; 318/455–461, 298

[56] References Cited

U.S. PATENT DOCUMENTS

| | | | |
|---|---|---|---|
| 4,776,676 | 10/1988 | Inoue et al. | 345/89 |
| 4,894,712 | 1/1990 | Katsukawa | 358/298 |
| 4,929,058 | 5/1990 | Numao | 345/89 |
| 5,010,327 | 4/1991 | Wakita et al. | 345/89 |
| 5,091,722 | 2/1992 | Kitajima et al. | 345/89 |
| 5,202,773 | 4/1993 | Kato | 358/461 |
| 5,459,495 | 10/1995 | Scheffer et al. | 345/89 |
| 5,583,530 | 12/1996 | Mano et al. | 345/89 |

OTHER PUBLICATIONS

"Liquid Crystal Display with High–Information Content" Bernhard S. Scheable, SID, May 23 & 27, 1988, pp. 9.2–9.38.

*Primary Examiner*—Richard Hjerpe
*Assistant Examiner*—Amare Mengistu
*Attorney, Agent, or Firm*—Antonelli, Terry, Stout & Kraus, LLP.

[57] ABSTRACT

In order to realize multi-level gradation representation with reduced crosstalk in a display apparatus of STN method, one horizontal interval is divided uniformly by the bit length n of a gradation level display in a display apparatus of STN method having a display panel of simple matrix type and having display luminance depending upon the root-mean-square value of applied voltage. Each of sections resulting from division is associated with a display bit. The applied voltage value of the display panel in each divisional section is adjusted so that the root-mean-square voltage value difference on a divisional section may become the density difference meant by the display bit. Since time is divided into nearly equal n parts to represent a gradation level, the minimum time interval resulting from division becomes longer that of the conventional technique. Since the frequency band in use is narrowed, the crosstalk is reduced. As a result, false images and flicker on the display screen can be suppressed.

17 Claims, 22 Drawing Sheets

FIG. 5

| | X1 | X2 | X3 | X4 |
|---|---|---|---|---|
| Y1 | 3 | 3 | 0 | 2 |
| Y2 | 0 | 2 | 0 | 0 |
| Y3 | 0 | 0 | 2 | 1 |
| Y4 | 0 | 0 | 3 | 0 |

METHOD FOR DRIVING APPARATUS

CROSS-REFERENCES TO RELATED APPLICATIONS

This application is related to copending applications Ser. No. 08/015,896 filed by H. Mano et al. on Feb. 10, 1993, Ser. No. 08/003,448 filed by T. Inuzuka et al. on Jan. 12, 1993, and Ser. No. 07/650,763 filed by T. Tachiuchi et al. on Feb. 5, 1991.

BACKGROUND OF THE INVENTION

The present invention relates to a driving method for realizing a multi-level gradation display in a display apparatus, more particularly in a display apparatus of simple matrix type.

As for the method for driving a liquid crystal display apparatus having a conventional liquid crystal display panel of simple matrix type, there is a driving method with averaging voltages as well known in the conventional art. Furthermore, as a more generalized driving method, there is an active driving method described in T. J. Scheffet et al., "Active Addressing Method for High-Contrast Video-Rate STN Displays", Society for Information Display 92 digest, pp. 228–231. Furthermore, as a method for providing display with gradation, there is known a pulse width modulation gradation display method (hereafter referred to as pulse width modulation method).

As for conventional pulse width modulation methods, there are the equally divided pulse width modulation method as described in JP-A-59-149393 and the weighted pulse width modulation method as described in JP-A-52-76897. In the former method, one horizontal interval is equally divided in time to make a gradation display. In the latter method, one horizontal interval is divided with time interval weights. Furthermore, there is a pulse width modulation method as described in U.S. Pat. No. 4,709,995, whereby one frame interval is divided to obtain the same effect as that of the above described method of dividing one horizontal interval in time.

The aforementioned equally divided pulse width modulation method and weighted pulse width modulation method will hereafter be described by referring to drawings.

First of all, the configuration of a liquid crystal display apparatus of simple matrix type will now be described. FIG. 4 is a block configuration diagram of a conventional liquid crystal display apparatus. The apparatus includes a liquid crystal panel 100, an X driving circuit 101, a Y driving circuit 102, a voltage generation circuit 103, a timing signal generation circuit 104, a display data control circuit 105, a vertical synchronizing signal input terminal 201, a horizontal synchronizing signal input terminal 202, a data clock input terminal 203, and a display data input terminal 204.

Input signals taken in the liquid crystal display apparatus from the outside include four kinds of signals: vertical synchronizing signal, horizontal synchronizing signal, data clock, and display data. The vertical synchronizing signal is a signal for indicating beginning of one picture. The horizontal synchronizing signal is a signal for indicating beginning of data transfer in the horizontal direction. The data clock is a clock synchronized with transmitted display data. On the basis of the data clock, the liquid crystal display apparatus can take in the transmitted display data. The time between a horizontal synchronizing signal and the next horizontal synchronizing signal is referred to as one horizontal interval. The time required to transfer information of the whole of one picture is referred to as one frame interval. In case data of one picture are transferred during an interval between a vertical synchronizing signal and the next vertical synchronizing signal, the time interval between vertical synchronizing signals becomes one frame interval.

It is now assumed that the signal of the display data supplied from the outside has 50 pictures per second; the display picture has an N×M matrix; the number of lines in the horizontal direction is M; and monochrome variable-density data having display gradation of n bits are transferred in a stream of d parallel bits. At this time, one frame interval is 1/50 second; one horizontal interval is 1/(50×M) second; and the data clock generates a synchronizing signal at intervals of d/(50×M×n) second. The characters N, M, n and d used here will also be used hereafter on the basis of similar definitions.

In the above described concrete example, the case where data corresponding to one picture is transmitted during an interval between a vertical synchronizing signal and the next vertical synchronizing signal has been described. In case of television, however, the interlaced scan method is used and only information of half a picture is transmitted during an interval between a vertical synchronizing signal and the next vertical synchronizing signal. Therefore, the interval between a vertical synchronizing signal and the next but one vertical synchronizing signal becomes one frame interval. In the above described concrete example, information corresponding to 30 pictures is transmitted during one second. Therefore, the case where information corresponding to 30 pictures is transmitted during one second in the above described concrete example is equivalent to the case where information corresponding to 60 half-pictures is transmitted during one second in the interlaced scan method.

Functions of respective components of the liquid crystal display apparatus and its signal flow until display is made will now be described by referring to the block configuration diagram of FIG. 4. Hereafter, description will be given by taking the Y direction as the horizontal direction and the X direction as the X direction.

The vertical synchronizing signal, horizontal synchronizing signal, and data clock are sent to the timing signal generation circuit 104. On the basis of the above described signals, the timing signal generation circuit 104 generates various synchronizing signals for activating respective circuits. Furthermore, the timing signal generation circuit 104 also generates a basic pulse waveform to be driven by the Y driving circuit 102. Each circuit operates on the basis of various synchronizing signals sent from the timing signal generation circuit. On the basis of the data clock sent from the timing signal generation circuit 104, the display data control circuit 105 takes in display data. On the basis of the display data thus taken in and the basic pulse waveform sent from the timing signal generation circuit 104, the display data control circuit 105 generates a pulse waveform to be driven by the X driving circuit 102. On the basis of a synchronizing signal sent from the timing signal generation circuit 104, the X driving circuit 102 reads waveform data supplied from the display data control circuit 105 and applies voltages based upon the above described waveform data to X electrodes of the display panel 100. On the basis of a synchronizing signal sent from the timing signal generation circuit 104, the Y driving circuit 102 receives basic waveform data from the timing signal generation circuit 104 and applies voltages based upon the above described basic waveform data to Y electrodes of the display panel 100. The voltage generation circuit 103 supplies a plurality of desired voltages to the X driving circuit 101 and the Y driving circuit 102. On the basis of respective waveform data, the X driving circuit 101 and the Y driving circuit 102 make switching selections from a plurality of voltages supplied from the voltage generation circuit 103 so that desired voltages may be applied to the liquid crystal panel 100 at desired timing. The liquid crystal panel 100 has such a structure that electrodes of X direction and electrodes of Y direction form a wire matrix and a thin liquid crystal layer is sandwiched between a thin transparent glass plate having electrodes of X direction arranged thereon and a thin transparent glass plate having electrodes of Y direction arranged thereon. If there is a potential difference between an electrode of X direction and an electrode of Y direction, the potential difference is applied to the liquid crystal located on a matrix intersection and a luminance display can be made by a change in transmittivity of light depending upon the root-mean-square value of voltage. FIG. 3 shows a graph representing the relation between the root-mean-square value of voltage applied to the liquid crystal and display luminance of the liquid crystal. Between Voff and Von of FIG. 3, the luminance display is substantially linear with respect to the root-mean-square value of voltage. In this section, root-mean-square values are provided with differences to make a gradation display.

If pulse waveforms generated by the X driving circuit and the Y driving circuit are suitably chosen, averaging the root-mean-square voltage value on each matrix intersection over one frame interval provides a root-mean-square voltage value depending upon the display luminance of each matrix intersection. Difference between various pulse width modulation methods for representing gradation resides in how this pulse waveform is decided.

The clock determining the time interval of the above described pulse waveform driven by the X driving circuit 101 and the Y driving circuit 102 is hereafter referred to as data latch clock. In case of a two-level gradation display, the data latch clock has the same period as one horizontal interval. In case of a multi-level gradation display, however, a data latch clock having a time interval shorter than one horizontal interval is issued with characteristic time division depending upon the pulse width modulation method.

Besides the configuration heretofore described, some liquid crystal display apparatuses are so designed that AC voltage may be applied to the liquid crystal. The simplest method thereof is to invert the positive or negative voltage polarity every frame. As the mechanism therefor, a command signal is generated in the timing signal generation circuit 104 and a mechanism for inverting voltage generated by the voltage generation circuit 103 every frame is provided, for example. The pulse waveform inverted in polarity can be easily estimated from the basic pulse waveform which is not inverted in polarity. Therefore, the following description will be given by referring to a pulse waveform without regard to polarity inversion.

In making a gradation display by using conventional pulse width modulation methods, it is the most important what pulse waveform the driving pulse has. Examples of the pulse waveform will be now described by referring to FIGS. 5 to 9. It is assumed in this case that matrix size of the display screen is 4×4 and a 4-level gradation display is used. That is to say, N=M=4 and the number of gradation levels m=4 in terms of the above described characters. Assuming now that the bit length expressing a gradation level is n, we get n=2.

FIG. 5 shows an example of display together with values of display luminance of the image to be displayed. By using driving pulse waveforms shown in FIG. 1 and FIGS. 6 to 12, the image having density gradation levels of FIG. 5 is obtained in every case. In FIG. 1 and FIGS. 6 to 12, the abscissa indicates time, whereas the ordinate indicates voltage values of respective electrodes of the liquid crystal panel 100. FIGS. 6 to 9 relate to the conventional technique, whereas FIG. 1 and FIGS. 10 to 12 relate to the present invention.

FIGS. 6 and 7 show examples of the conventional equally divided pulse width modulation. In FIG. 6, one horizontal interval is divided into three equal parts and the time depending upon each display gradation level is selected for voltage application. On the other hand, in FIG. 7, one frame interval is divided into three equal field intervals and the number of applied field intervals is determined according to each display gradation level. In both methods, the root-mean-square voltage value at each point on the matrix is adapted to have a value depending upon the density gradation level as an average over one horizontal interval. FIG. 6 becomes completely identical with FIG. 7 by performing temporal interchange in one frame interval. The equally divided pulse width modulation is characterized by dividing time into (m−1) equal parts for the number of gradation levels m.

FIGS. 8 and 9 show examples of conventional weighted pulse width modulation. In FIG. 8, one horizontal interval is divided into two temporal parts having the ratio of one to two. Because of time division with a ratio of one to two performed according to the density level meant by display bits, bits of display data correspond to time sections resulting from division, respectively. Directly depending upon data of display bits, it is determined whether application is to be performed or not during time sections corresponding thereto. In FIG. 9, one frame interval is divided into two field intervals having a ratio of one to two. If temporal interchange is performed, FIGS. 9 and 8 become identical with each other. Furthermore, FIGS. 6 and 7 become identical with each other and FIGS. 8 and 9 become identical with each other if temporal interchange is performed. The equally divided pulse width modulation and weighted pulse width modulation are identical with each other for temporal interchange and differ only in whether time division directly depending upon display bits is performed or not. In case of the weighted pulse width modulation as well, therefore, the minimum division time is the same as that of the equally divided pulse width modulation and becomes time obtained by dividing one frame interval into m−1 equal parts. The used frequency band also becomes identical.

The pulse waveform will hereafter be described more generally by using numerical expressions.

First of all, in case of the equally divided pulse width modulation, $$Y(j,p,t) = a \cdot \phi(j,t) \quad \text{(eq. 1)}$$

$$X(i,p,t) = b \cdot \sum_{j=1}^{M} I(i,j,p) \cdot \phi(j,t) \quad \text{(eq. 2)}$$

where i and j indicate the order in the matrix of the liquid crystal panel 100 and mean the ith row of the jth column. The value of i is an integer ranging from 1 to N, and the value of j is an integer ranging from 1 to M.

The character p is a number assigned to a section obtained by dividing one frame interval into m−1 equal parts to represent a density gradation level of display data, and p assumes an integer value ranging from 1 to m−1.

The character t represents time counted for each of sections obtained by dividing time into m−1 equal parts.

Y(j,p,t) means a voltage waveform generated by the jth Y driving circuit at time t in the pth division section, and it becomes a voltage waveform applied to the jth row of the above described matrix.

X(i,p,t) means a voltage waveform generated by the ith X driving circuit at time t in the pth division section, and it becomes a voltage waveform applied to the ith row of the above described matrix.

Characters a and b are constants.

I(i,j,p) is a value based upon display data and it depends upon the density level g(i,j) of the ith row of the jth column in the above described matrix and the section number p. If the density level g(i,j) is defined by an integer ranging from 0 to m−1, I(i,j,p has the following value.

$$I(i,j,p)=-1(\text{for } p\leqq g(i,j)) \quad \text{(eq. 3)}$$

$$I(i,j,p)=1(\text{for } p>g(i,j)) \quad \text{(eq. 4)}$$

In these equations, ϕ(j,t) is a basic pulse waveform. In case of the equally divided pulse width modulation method shown in FIGS. 6 and 7, the voltage averaging driving method is used as the driving method and hence ϕ(j,t) becomes the following function.

$$\phi(j,t)=0(\text{for } t<j-1, \text{ or } t\geqq j) \quad \text{(eq. 5)}$$

$$\phi(j,t)=1(\text{for } j-1\leqq t<j) \quad \text{(eq. 6)}$$

In these equations, t is so defined that time interval obtained by dividing one horizontal interval into m−1 equal parts may be taken as basic time interval 1 and counting may be started from 0 and stopped immediately before m−1.

Furthermore, it is also possible to use orthogonal functions having a constant norm as the system of function of ϕ(j,t). The method using the orthogonal functions having a constant norm is called active driving method. That is to say, in the active driving method, $$\int dt\phi(i,t)\phi(j,t)=0(\text{for } i\neq j) \quad \text{(eq. 7)}$$

$$\int dt\phi(i,t)\phi(j,t)=\text{constant (for } i=j) \quad \text{(eq. 8)}$$

where the integration range covers the whole of one section included in sections obtained by dividing one frame interval into m−1 equal parts.

FIG. 6 differs from FIG. 7 only in the order of application of X(i,p,t) and Y(j,p,t). As easily understood, there are all combinations with p and t interchanged besides it.

The pulse waveform for the weighted pulse width modulation will now be represented by using numerical expressions:

$$Y(j,k,t) = a \cdot \phi(j,t/(2^{**}(n-k))) \quad \text{(eq. 9)}$$

$$X(i,p,t) = b \cdot \sum_{j=1}^{M} I(i,p,t) \cdot \phi(j,t/(2^{**}(n-k))) \quad \text{(eq. 10)}$$

where k is the bit order representing the density gradation level of display data and it means the kth bit representing the density gradation level included in n bits in all. The lowest order with k=n yields the least density difference. As k becomes smaller, the density difference is widened twice by twice.

Time division is performed so that the lowest order with k=n may yield the time interval obtained by dividing one horizontal interval into m−1 parts and thereafter the time interval may be extended to twice whenever k decreases by 1. In order to represent this change of time scale, expression of ϕ(j,t/(2(n−k))) has been used. 2(n−k) means the (n−k)th power of 2, and t/(2(n−k)) means that the time scale has been expanded to 2(n−k) times.

Definitions of other characters are the same as those for equations 1 and 2.

The weighted pulse width modulation differs from the equally divided pulse width modulation in that the waveform ϕ(j,t/(2(n−k))) changed in time scale is used. ϕ(j,t/(2(n−k))) can be made by arranging 2**(n−k) ϕ(j,t)s. If appropriate temporal interchange is performed, the equally divided pulse width modulation and the weighted pulse width modulation become identical with each other.

The above described parameters a and b may have arbitrary values. Usually, however, such a ratio as to maximize the difference in root-mean-square voltage value caused by luminance is chosen. The ratio depends upon the number M of horizontal lines of the matrix and the relation a:b= $\sqrt{M}$:1 holds true.

Heretofore, the conventional pulse width modulation has been described. It should be especially noticed that in the conventional pulse width modulation method the parameters a and b are constant without depending upon p and k and the minimum time interval for driving the pulse waveform becomes equal to time interval obtained by dividing one horizontal interval into m−1 equal parts.

If the equally divided pulse width modulation or the weighted pulse width modulation is performed in a display apparatus of simple matrix type as in the above described conventional method, the minimum time interval for driving the pulse waveform becomes equal to time interval obtained by dividing one horizontal interval into m−1 equal parts. If the number of density gradation levels m becomes larger, therefore, the mimimum time interval for pulse driving becomes shorter in substantially inverse proportion thereto and the frequency band in use becomes larger. As the band increases, much crosstalk appears in the apparatus of simple matrix type in the high frequency region and false images and flicker appear in the display image.

SUMMARY OF THE INVENTION

An object of the present invention is to provide a display apparatus causing less crosstalk and a driving method thereof.

In order to provide a display apparatus of simple matrix type with display gradation levels, duration of one horizontal interval is divided and the value of voltage applied to at least one of the X electrode and the Y electrode is controlled so that a desired root-mean-square voltage value may be obtained for each of sections resulting from time division.

In accordance with the present invention, the way of time division for providing gradation is altered and the applied voltage is adjusted accordingly, in order to reduce crosstalk. In first and second embodiments, one horizontal interval is divided into n equal temporal parts, where n is the number of bits for representing gradation, or one horizontal interval is divided into q equal temporal parts, where q is sufficiently close to n. In the first embodiment, voltage applied to the Y electrode is adjusted to produce a desired root-mean-square voltage value in each section resulting from time division. In the second embodiment, voltages applied to the X electrode and Y electrode are adjusted to produce a desired root-mean-square voltage value. In a third embodiment, time division is performed not equally but nearly equally and the applied voltage value is adjusted accordingly to produce a desired root-mean-square voltage value.

The root-mean-square voltage value on a matrix intersection depends upon three values: application time, the voltage value of the X electrode, and the voltage value of the Y electrode. For the X electrode, there are a pair of voltage values having opposite polarities within each of the noted time divisions, respectively. According to the display gradation level, either of the voltage values is selected. For the Y electrode, there are two predetermined voltage values: 0 and a predetermined value within each of the noted time divisions, respectively. They are applied as operation voltage in accordance with a predetermined rule. The difference in root-mean-square voltage value between the positive voltage value and the negative voltage value of the X electrode becomes equivalent to the product of three terms: application time, the absolute value of the voltage of the X electrode, and the voltage value of the Y electrode. Even if the application time is changed, therefore, it is possible to make the difference between root-mean-square values unchanged by adjusting the applied voltage accordingly.

By the time division of the present invention, the minimum time interval for driving the pulse waveform has become the value obtained by dividing one horizontal interval into n equal parts or has become a value sufficiently close to the value thus obtained. In the conventional technique, the minimum time interval had a value obtained by dividing one horizontal interval into m−1 equal parts. Since m can be made large up to the nth power of 2, the minimum time interval of the pulse waveform in the present invention can be made markedly longer as compared with the conventional technique and crosstalk caused by using the high-frequency band can also be reduced. If one horizontal interval is divided into n equal parts, for example, and n=6, then m is 64. In case of division into 64 parts in the conventional technique, high-frequency crosstalk is large. In the present invention, however, division into 6 equal parts suffices and hence the frequency band is reduced to one tenth, resulting in markedly reduced crosstalk.

BRIEF DESCRIPTION OF THE DRAWING

FIG. 5 is a diagram showing an example of a 4-level gradation display in a 4×4 display matrix;

DESCRIPTION OF THE PREFERRED EMBODIMENTS

Embodiments of the present invention will hereafter be described by referring to FIGS. 1 and 2, FIG. 5, FIGS. 10 to 12, and Tables 1 to 6.

Figure 2:
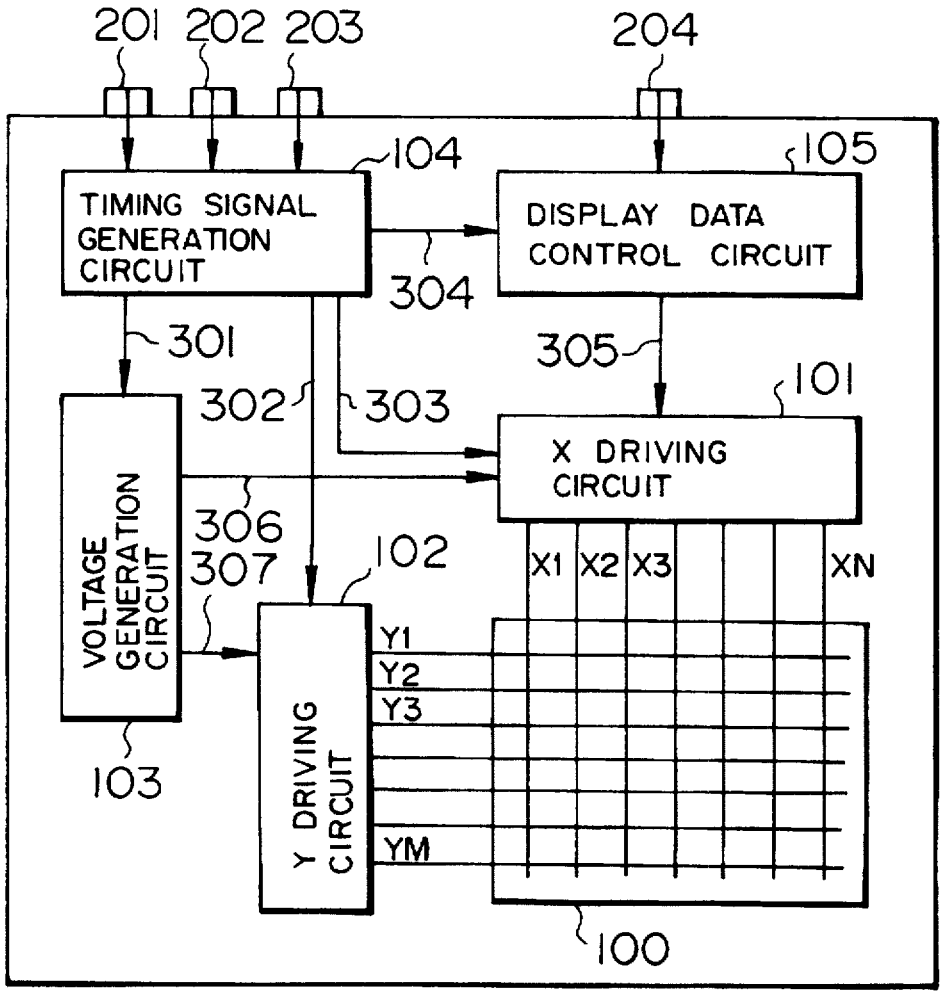
FIG. 2 is a block configuration diagram of a liquid crystal display apparatus according to the present invention.
Figure 3:
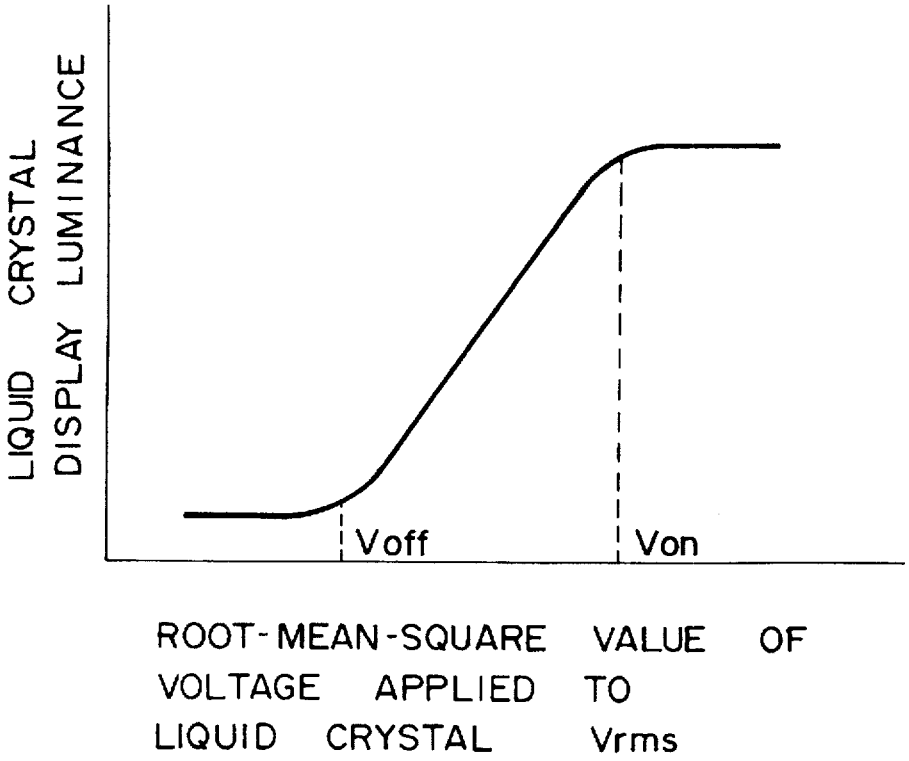
FIG. 3 is a diagram showing the root-mean-square voltage value applied to a liquid crystal display panel and the obtained display luminance.

FIG. 2 is a block configuration diagram of a liquid crystal display apparatus whereto the present invention is applied. FIG. 2 is the same as the conventional configuration diagram shown in FIG. 4 with the exception of one portion. Identical portions have already been described in the description of the conventional technique. Therefore, only the different portion will hereafter be described.

Figure 4:
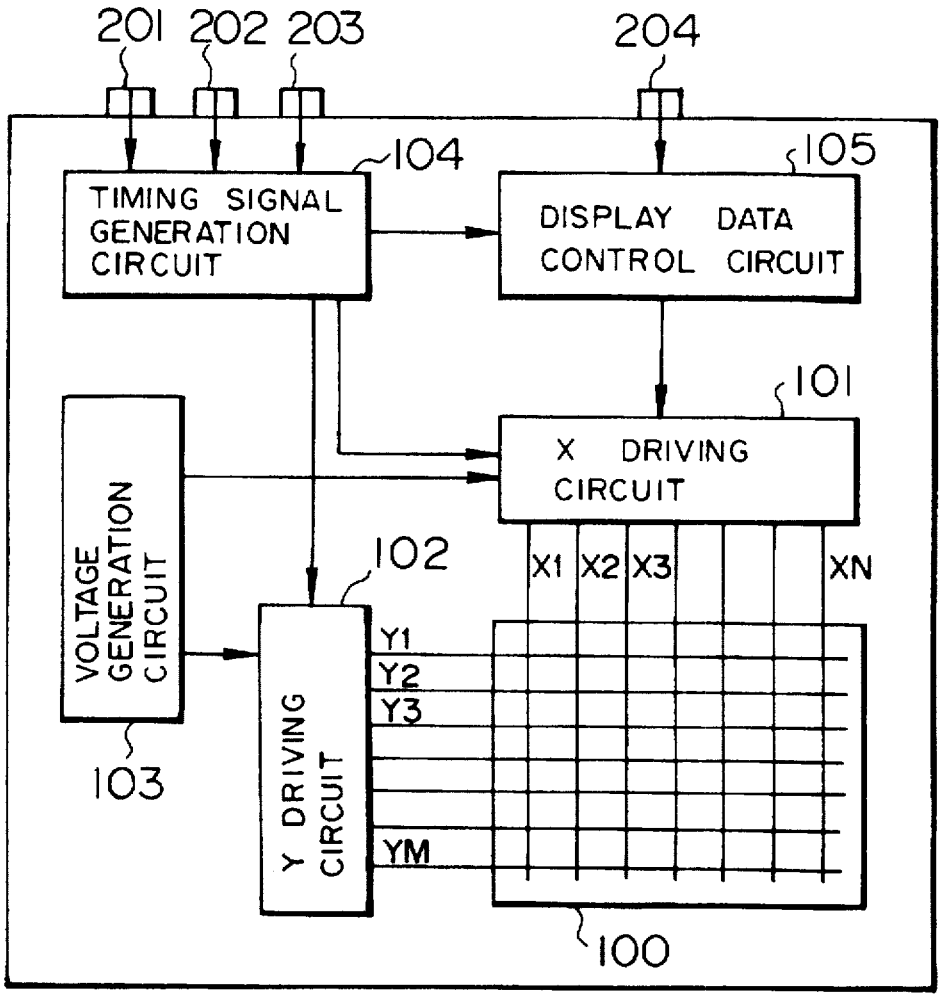
FIG. 4 PRIOR ART
FIG. 4 is a block configuration diagram of a conventional liquid crystal display apparatus.
Figure 6:
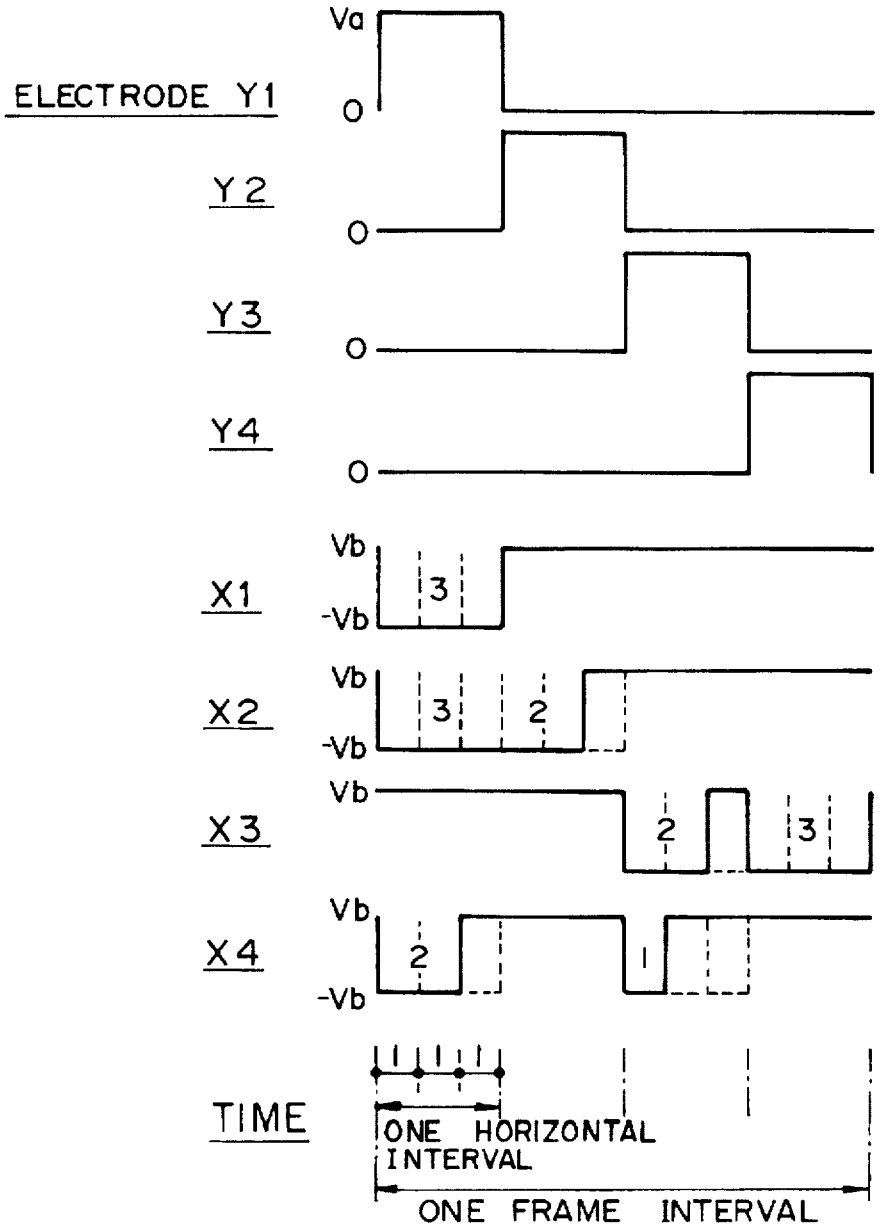
FIG. 6 PRIOR ART
FIG. 6 is an example of driving pulse waveforms for making a 4-level gradation display of a conventional equally divided pulse width modulation method.
Figure 7:
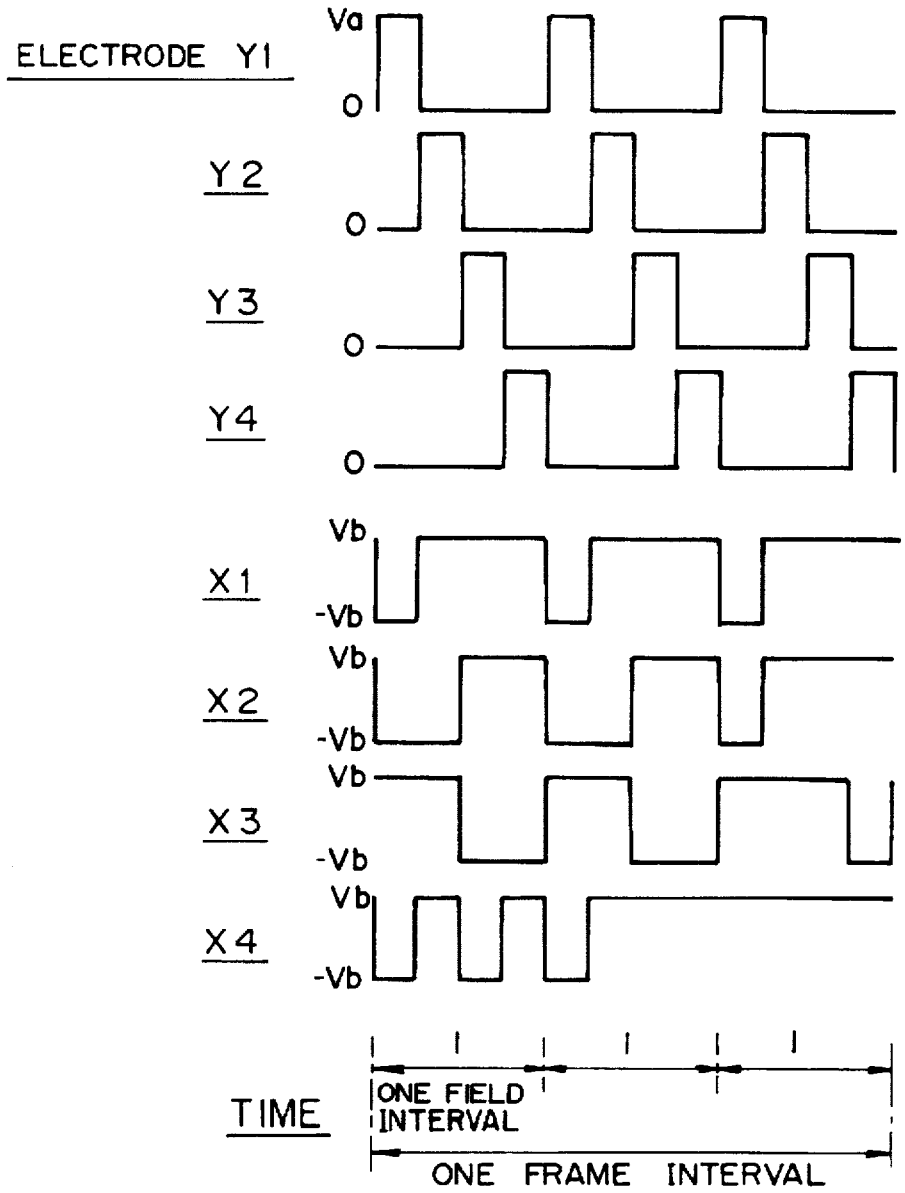
FIG. 7 PRIOR ART
FIG. 7 is a diagram showing another example of driving pulse waveforms for making a 4-level gradation display of a conventional equally divided pulse width modulation method.
Figure 8:
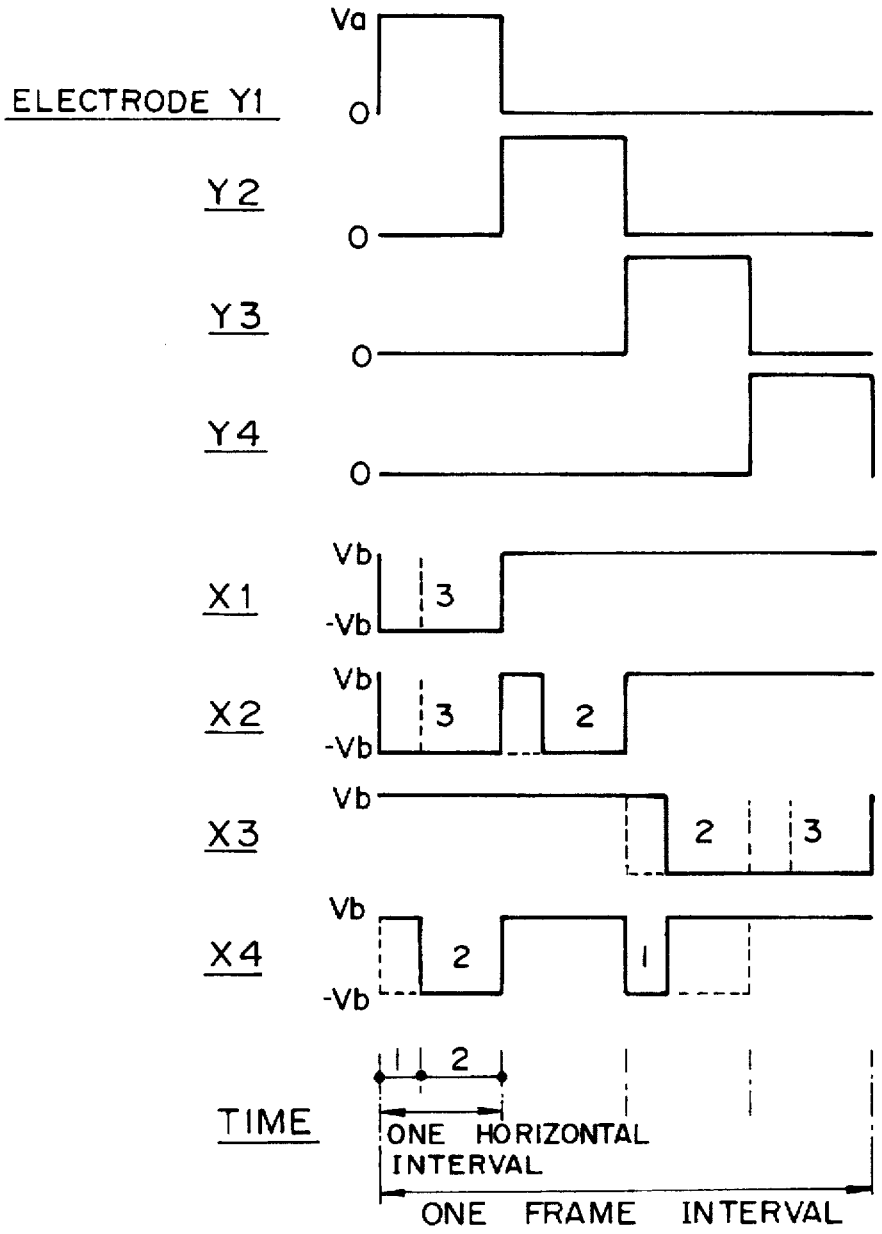
FIG.8 PRIOR ART
FIG. 8 is a diagram showing an example of driving pulse waveforms for making a 4-level gradation display of a conventional weighted pulse width modulation method.
Figure 9:
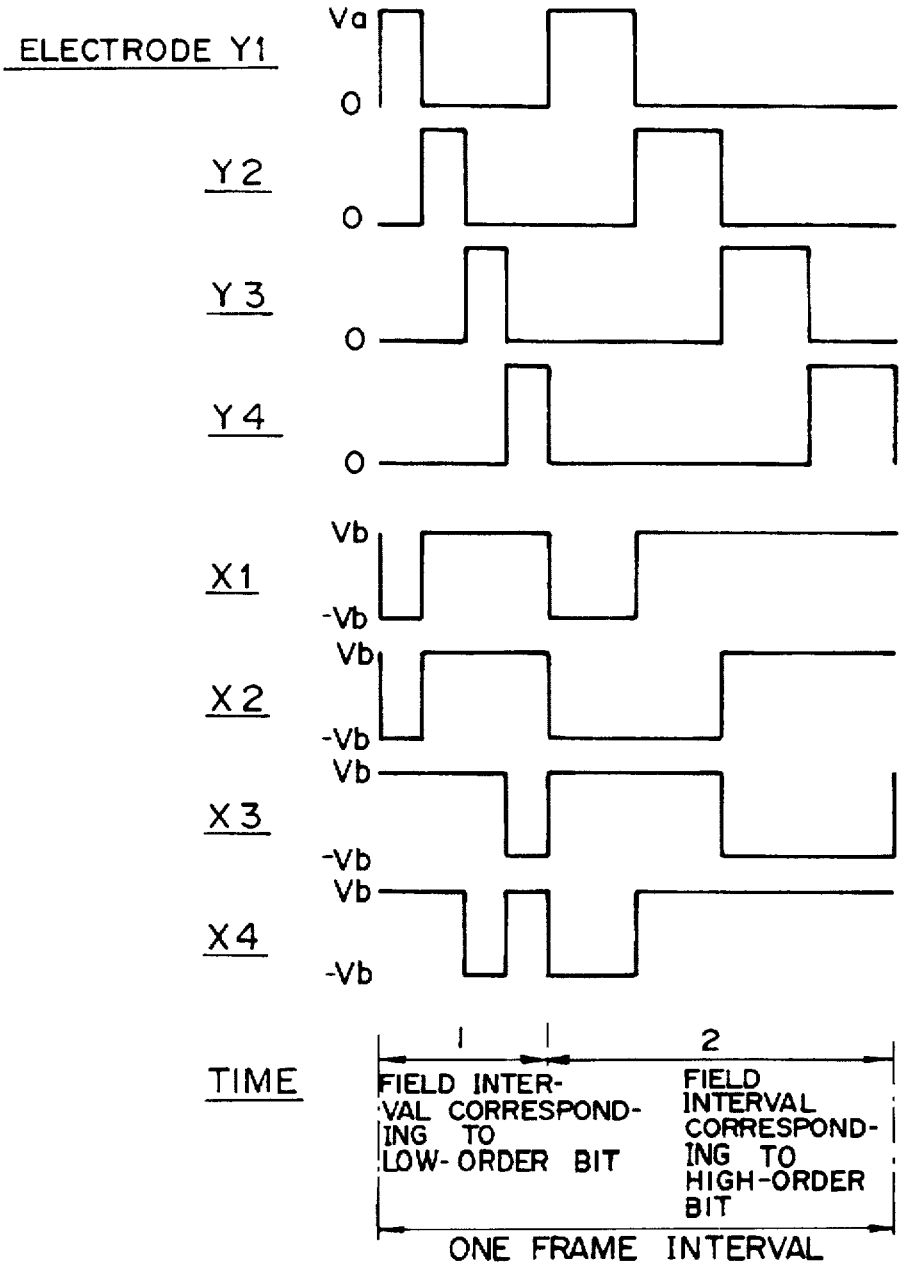
FIG. 9 PRIOR ART
FIG. 9 is a diagram showing another example of driving pulse waveforms for making a 4-level gradation display of a conventional weighted pulse width modulation method.

In accordance with the present invention, one horizontal interval is divided into n equal parts, where n is the bit length of a gradation display. For each of sections resulting from division, a voltage value depending upon the density difference served by the section is applied to a liquid crystal panel 100. As a mechanism for that purpose, a command signal C is generated by a timing signal generation circuit 104 shown in the configuration diagram of FIG. 2. For each of the above described sections resulting from division, the command signal C changes voltage produced by a voltage generation circuit 103. On the basis of the command signal C supplied from the timing signal generation circuit 104, the voltage generation circuit 103 changes voltage values supplied to an X driving circuit 101 and a Y driving circuit 102. Besides the apparatus configuration based upon FIG. 2 heretofore described, other apparatus configurations implementing the present invention can be considered. For example, even in the case of FIG. 4 showing the conventional configuration, the present invention can be implemented. In this case, the voltage generation circuit 103 generates all of voltage values needed in the present invention, and a plurality of voltages thus generated are supplied to the X driving circuit 101 and the Y driving circuit 102. Respective driving circuits switch necessary voltages and apply them to the liquid crystal display panel 100.

Driving voltage pulse waveforms applied to the liquid crystal display panel 100 forming the nucleus of the present invention are exemplified in FIG. 1 and FIGS. 10 to 12. In the same way as the above described conventional technique, the pulse waveforms shown in FIG. 1 and FIGS. 10 to 12 correspond to the case where the display screen has a 4×4 matrix and a 4-level gradation display is made, the display image shown in FIG. 5 being thus obtained. That is to say, in terms of characters, N=M=4, the number of gradation levels m=4, and the bit length representing a gradation level n=2.

Figure 10:
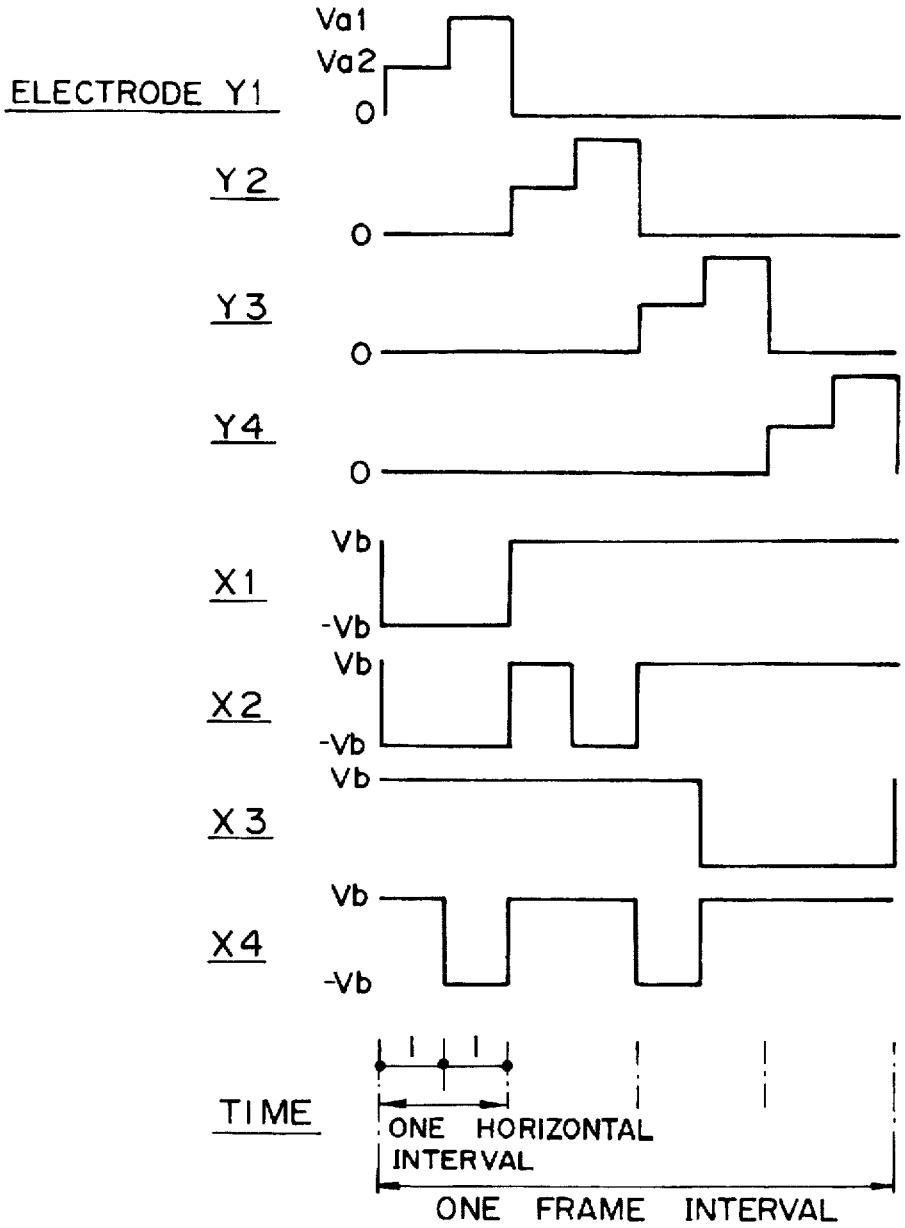
FIG. 10 is a diagram showing an example of driving pulse waveforms for making a 4-level gradation display in a first embodiment of the present invention.
Figure 11:
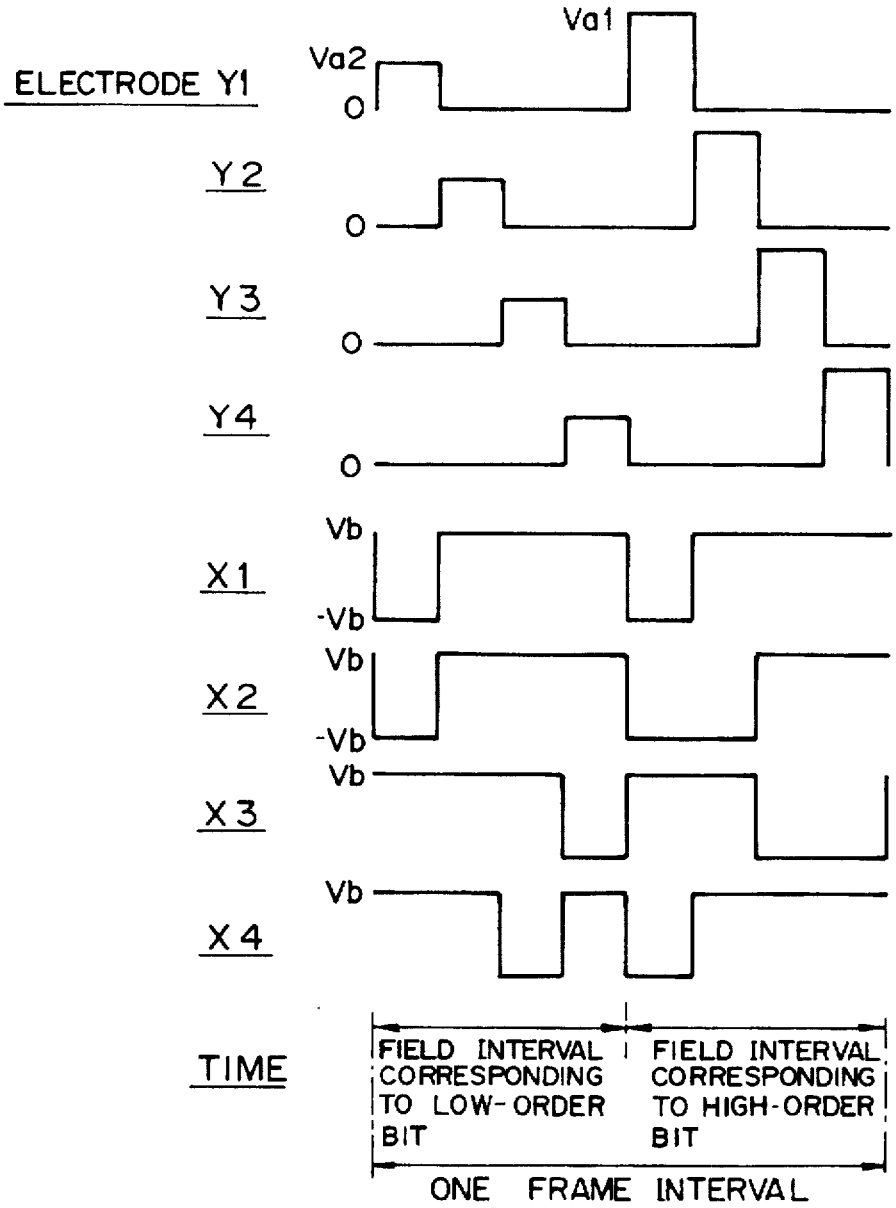
FIG. 11 is a diagram showing another example of driving pulse waveforms for making a 4-level gradation display in the first embodiment of the present invention.

The driving pulse waveform based upon a first embodiment of the present invention will hereafter be described by referring to FIGS. 10 and 11.

In FIG. 10, one horizontal interval is divided into two equal parts, and respective sections are associated with display bits. Voltage values of the Y electrodes are then adjusted so that desired density difference of the each display bit may appear. The former section obtained by dividing one horizontal interval into two equal parts is associated with the low-order display bit (k=2), whereas the latter section is associated with the high-order display bit (k=1).

In FIG. 11, one frame interval is divided into two equal parts (field intervals) and respective sections are associated with display bits in the same way. FIGS. 10 and 11 are identical with each other if temporal interchange is performed in one frame interval. Besides them, there are a large number of combinations which become equivalent by performing temporal interchange.

Figure 1:
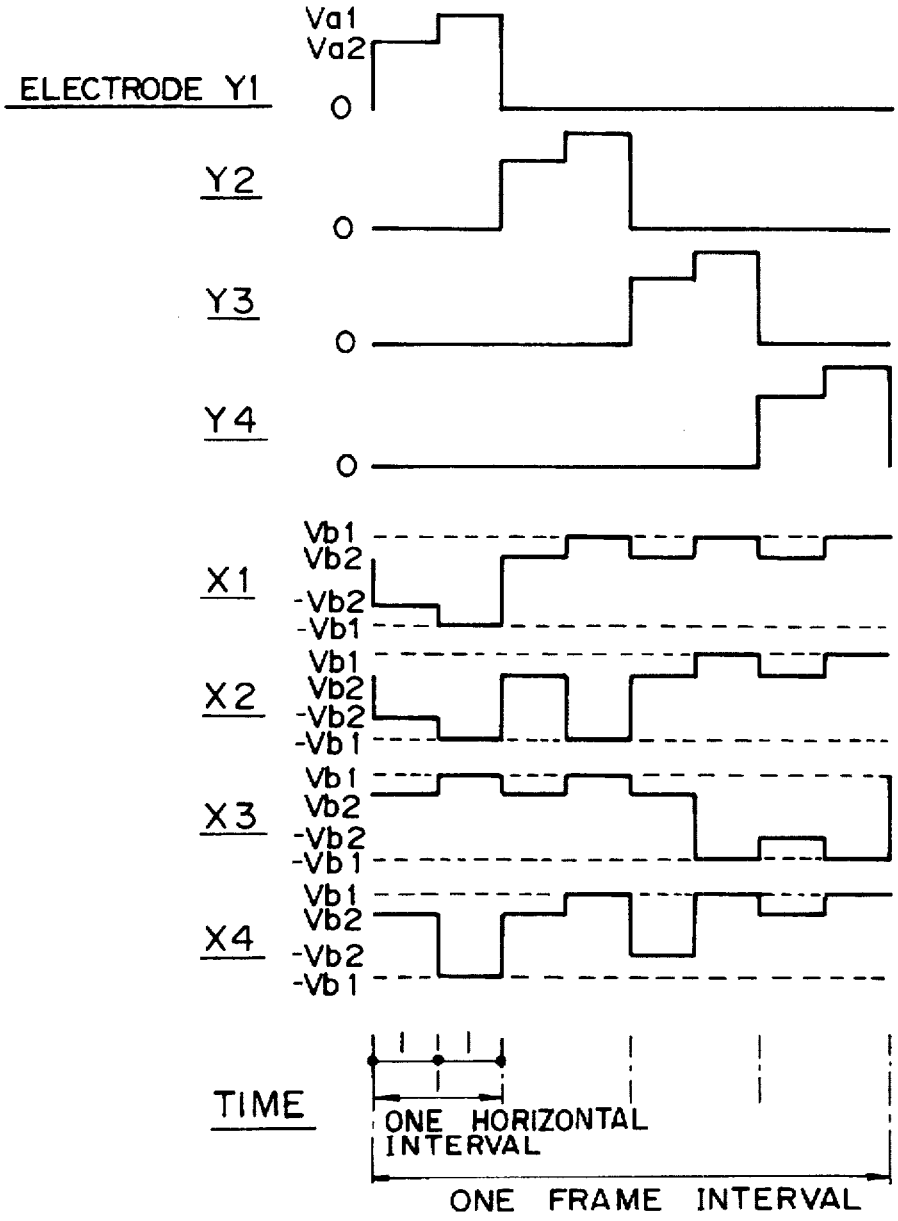
FIG. 1 is a diagram showing an example of driving pulse waveforms for making a 4-level gradation display in a second embodiment of the present invention.
Figure 12:
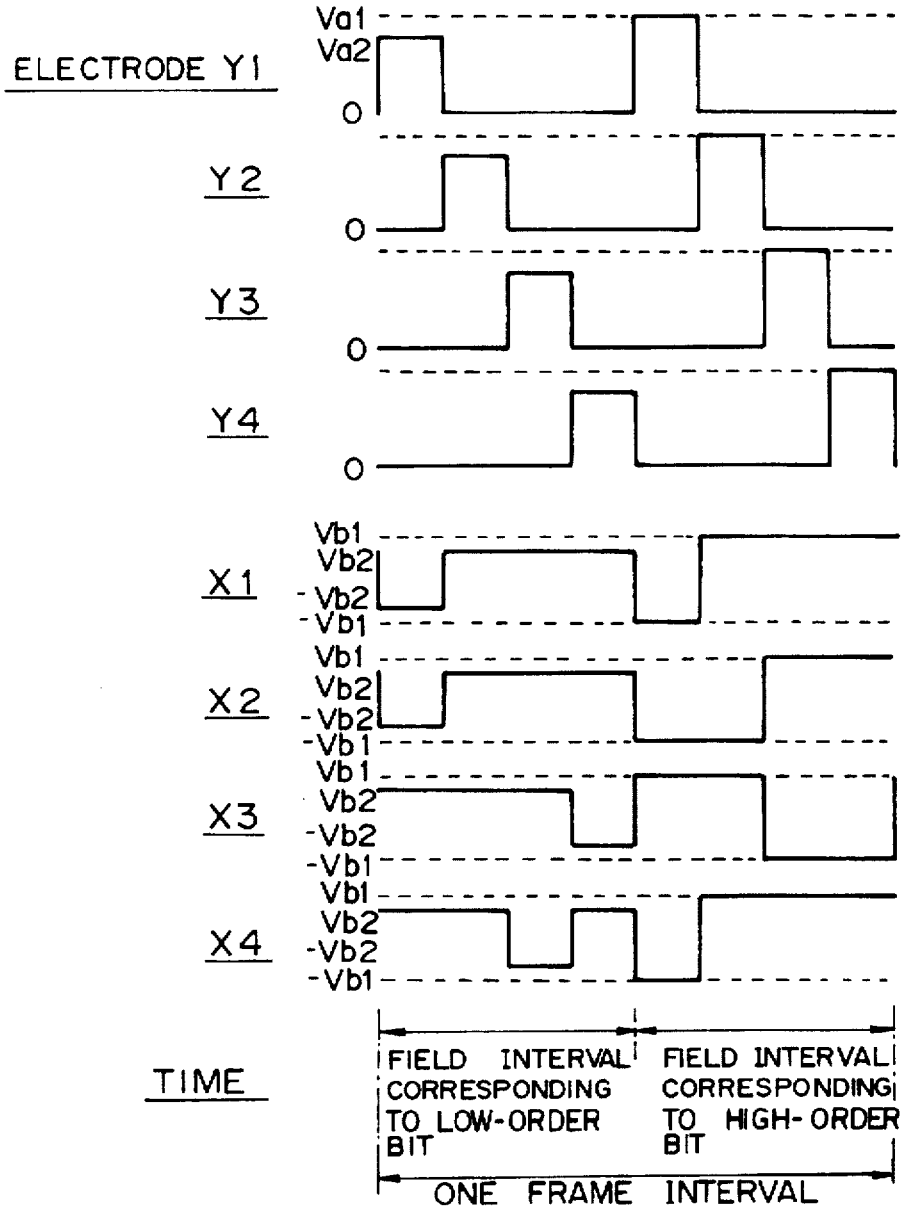
FIG. 12 is a diagram showing another example of driving pulse waveforms for making a 4-level gradation display in the second embodiment of the present invention.

Driving pulse waveforms based upon a second embodiment of the present invention will hereafter be described by referring to FIG. 1 and FIG. 12.

In FIG. 1, one horizontal interval is divided into two equal parts, and respective sections are associated with display bits. Voltage values of the X electrodes and voltage values of the Y electrodes are then adjusted so that desired density difference of the each display bit may appear. In the same way, the former section obtained by dividing one horizontal interval into two equal parts is associated with the low-order display bit (k=2), whereas the latter section is associated with the high-order display bit (k=1).

In FIG. 12, one frame interval is divided into two equal parts (field intervals) and respective sections are associated with display bits. FIGS. 1 and 12 are identical with each other if temporal interchange is performed in one frame interval. Besides them, there are a large number of combinations which become equivalent by performing temporal interchange.

As heretofore described, in the first embodiment of the present invention, the difference of root-mean-square voltage corresponding to display bits is provided by adjusting the voltage value of the Y driving circuit. In the second embodiment of the present invention, the difference of root-mean-square voltage corresponding to display bits is provided by adjusting the voltage value of the X driving circuit and adjusting the voltage value of the Y driving circuit.

General description of the driving pulse waveform of the present invention will now be given by referring to numerical equations.

$$Y(j,k,t) = a(k) \cdot \phi(j,k,t) \quad \text{(eq. 11)}$$

$$X(i,k,t) = b(k) \cdot \sum_{j=1}^{M} I(i,j,k) \cdot \phi(j,k,t) \quad \text{(eq. 12)}$$

In these equations, definitions of characters are the same as those of equations 1 to 10 of the conventional technique and they will now be described.

Characters i and j indicate the order in the matrix of the liquid crystal panel 100 and mean the ith row of the jth column. The value of i is an integer ranging from 1 to N, and the value of j is an integer ranging from 1 to M.

The character k is the order of a bit representing the density gradation level of display data and means the kth bit among n bits in all representing a density gradation level.

The character t represents time counted for each of sections obtained by dividing time into n equal parts.

Y(j,k,t) means a voltage waveform generated by the jth Y driving circuit at time t in the kth division section, and it becomes a voltage waveform applied to the jth row of the above described matrix.

X(i,k,t) means a voltage waveform generated by the ith X driving circuit at time t in the kth division section, and it becomes a voltage waveform applied to the ith row of the above described matrix.

Characters a(k) and b(k) are constants depending upon the bit order k representing the gradation level. In the conventional technique, they do not depend upon k.

I(i,j,k) is a value based upon display data. If the ith row of the jth column of the above described matrix is to be provided with the density of the kth bit, I(i,j,k) is −1. Unless the ith row of the jth column of the above described matrix is to be provided with the density of the kth bit, I(i,j,k) is 1.

$\phi(j,k,t)$ is a basic pulse waveform. In case of FIG. 1 and FIGS. 10 to 12, the voltage averaging driving method is used as the driving method and $\phi(j,k,t)$ is defined as the following function.

$$\phi(j,k,t)=0(\text{for } t<j-1, \text{ or } t\geqq j) \quad \text{(eq. 13)}$$

$$\phi(j,k,t)=1(\text{for } j-1\leqq t<j) \quad \text{(eq. 14)}$$

In these equations, t is so defined that time interval obtained by dividing one horizontal interval into n equal parts may be taken as basic time interval 1 and counting may be started from 0 and stopped immediately before n.

Furthermore, it is also possible to use orthogonal functions having a constant norm as the system of function of $\phi(j,k,t)$. The system of function expressed by equations 13 and 14 is also a kind of orthogonal function having a constant norm. In the active driving method using a general orthogonal function having a constant norm, $$\int dt\,\phi(i,k,t)\phi(j,k,t)=0(\text{for } i\neq j) \quad \text{(eq. 15)}$$

$$\int dt\,\phi(i,k,t)\phi(j,k,t)=\text{constant (for } i=j) \quad \text{(eq. 16)}$$

where the integration range covers the whole of one section included in sections obtained by dividing one frame interval into n equal parts.

The system of orthogonal function of $\phi(j,k,t)$ used in equations 11 to 16 is employed during one frame interval. During the next frame interval, it is also possible to use a system of function different from the previous system of function or interchange orders of systems of function. Furthermore, in the example of orthogonal function system $\phi(j,k,t)$ expressed in equations 13 and 14, the systems of function are the same irrespective of k. However, it is also possible to change the system of function or interchange systems of function according to k.

If the ith row of the jth column of the above described matrix is to be provided with the density of the kth bit, the value of the above described I(i,j,k) is defined as −1. Unless the ith row of the jth column of the above described matrix is to be provided with the density of the kth bit, I(i,j,k) is defined as 1. However, this is true of the case where the coefficients a(k) and b(k) have been adjusted so that the root-mean-square voltage value of the division section resulting from dividing into n equal parts may become the difference of root-mean-square value corresponding to display bit. In case a nonlinear response is strong in the relation between the root-mean-square voltage value and the display luminance, the step of the root-mean-square voltage must be changed so that the display luminance may become linear. At that time, the comparative magnitude relation among 2**n root-mean-square voltage values which can be represented by combinations of root-mean-square voltage values of sections obtained by dividing into n equal parts need not necessarily be the same as the comparative magnitude relation at the time when the original bits for driving mean a numeral. At this time, display data are converted into a bit train for driving in order to properly associate values based upon display data with density gradation levels obtained after driving. In keeping therewith, the meaning of k appearing in the equations 11 to 16 is also redefined as the order of the above described bit train for driving instead of the order of the bit train representing display data. That is to say, each of sections obtained by dividing one horizontal interval into n equal parts corresponds to a bit for driving. And values of the coefficients a(k) and b(k) are determined so that the desired difference between root-mean-square voltage values for each driving bit may appear in the section in charge thereof. If the value of the root-mean-square voltage value for obtaining a desired display luminance has a nonlinear step because of relationship between the root-mean-square voltage value and display luminance, and at least one of those root-mean-square voltage values cannot be produced from only the combination of n root-mean-square voltage values assigned to the above described sections obtained by dividing one horizontal interval into n equal parts, then one horizontal interval is divided into q equal parts, where q is larger than n, so that all of desired root-mean-square voltage values may be produced from combinations of root-mean-square voltage values of the above described sections obtained by dividing one horizontal interval into q equal parts. In this case, n in equations 11 to 16 is replaced by q, and the meaning of k is interpreted as the order of the driving bit. The optimum value of q is obtained by making q close to n as far as possible. However, a suboptimal value of q which is slightly larger than the optimum value also exists.

For the case where the relationship between the root-mean-square voltage value and the display luminance is linear, how to determine the parameter values a(k) and b(k) appearing in equations 11 and 12 will now be described by referring to Tables 1 to 6.

Under the table frames of Tables 1 to 6, values of the parameters a(k) and b(k) are indicated. For the case where the voltage averaging driving method is used as the driving method, i.e., for the case where the basic pulse waveform $\phi(j,t)$ is the function expressed by equations 13 and 14, voltage values of respective electrodes of the liquid crystal display panel 100 are indicated within the frames. Within the table frames, voltage values supplied to the X electrode and the Y electrode are identified by the on-state and off-state. In the on-state of the Y electrode, the basic pulse waveform is $\phi(j,t)=1$ as expressed by equation 14. In the off-state of the Y electrode, the basic pulse waveform is $\phi(j,t)=0$ as expressed by equation 13. In the on-state of the X electrode, the value of the voltage X(i,k,t) supplied to the X electrode as expressed by equation 12 becomes −b(k). In the off-state of the X electrode, the value of the voltage X(i,k,t) becomes b(k).

For case of a 4-level gradation display in the first embodiment of the present invention, Table 1 shows values of parameters a(k) and b(k) and voltage values supplied to respective electrodes.

TABLE 1

| LUMINANCE | Y ELECTRODE | | X ELECTRODE | |
|---|---|---|---|---|
| BIT | STATE | POTENTIAL | STATE | POTENTIAL |
| 1 | on | Va | on | −Vb |
| | off | 0 | off | Vb |
| 2 | on | Va/2 | on | −Vb |
| | off | 0 | off | Vb |

a(1) = Va,
b(1) = Vb
a(2) = Va/2,
b(2) = Vb

Table 2 shows the case of a 4-level gradation display in the second embodiment of the present invention.

TABLE 2

| LUMINANCE | Y ELECTRODE | | X ELECTRODE | |
|---|---|---|---|---|
| BIT | STATE | POTENTIAL | STATE | POTENTIAL |
| 1 | on | Va | on | −Vb |
| | off | 0 | off | Vb |
| 2 | on | $Va/\sqrt{2}$ | on | $-Vb/\sqrt{2}$ |
| | off | 0 | on | $Vb/\sqrt{2}$ |

a(1) = Va,
b(1) = Vb
$a(2) = Va/\sqrt{2}$ ,
$b(2) = Vb/\sqrt{2}$

Table 3 shows the case where the first of the present invention is applied to a 16-level gradation display.

TABLE 3

| LUMINANCE | Y ELECTRODE | | X ELECTRODE | |
|---|---|---|---|---|
| BIT | STATE | POTENTIAL | STATE | POTENTIAL |
| 1 | on | Va | on | −Vb |
| | off | 0 | off | Vb |
| 2 | on | Va/2 | on | −Vb |
| | off | 0 | off | Vb |
| 3 | on | Va/4 | on | −Vb |
| | off | 0 | off | Vb |
| 4 | on | Va/8 | on | −Vb |
| | off | 0 | off | Vb |

a(1) = Va,
b(1) = Vb
a(2) = Va/2,
b(2) = Vb
a(3) = Va/4,
b(3) = Vb
a(4) = Va/8,
b(4) = Vb

In Tables 4 to 6, three kinds of examples of here the second embodiment of the present is applied to a 16-level gradation display are shown.

TABLE 4

| LUMINANCE | Y ELECTRODE | | X ELECTRODE | |
|---|---|---|---|---|
| BIT | STATE | POTENTIAL | STATE | POTENTIAL |
| 1 | on | Va | on | −Vb |
| | off | 0 | off | Vb |
| 2 | on | $Va/\sqrt{2}$ | on | $-Vb/\sqrt{2}$ |
| | off | 0 | off | $Vb/\sqrt{2}$ |
| 3 | on | Va/2 | on | −Vb |
| | off | 0 | off | Vb |
| 4 | on | $Va/\sqrt{8}$ | on | $-Vb/\sqrt{8}$ |
| | off | 0 | off | $Va/\sqrt{8}$ |

TABLE 4-continued

| LUMINANCE | Y ELECTRODE | | X ELECTRODE | |
|---|---|---|---|---|
| BIT | STATE | POTENTIAL | STATE | POTENTIAL |

a(1) = Va,
b(1) = Vb
a(2) = Va/$\sqrt{2}$ ,
b(2) = Vb/$\sqrt{2}$
a(3) = Va/2,
b(3) = Vb/2
a(4) = Va/$\sqrt{8}$ ,
b(4) = Vb/$\sqrt{8}$

TABLE 5

| LUMINANCE | Y ELECTRODE | | X ELECTRODE | |
|---|---|---|---|---|
| BIT | STATE | POTENTIAL | STATE | POTENTIAL |
| 1 | on | Va | on | −Vb |
| | off | 0 | off | Vb |
| 2 | on | Va/2 | on | −Vb |
| | off | 0 | off | Vb |
| 3 | on | Va/2 | on | −Vb/2 |
| | off | 0 | off | Vb/2 |
| 4 | on | Va/4 | on | −Vb/2 |
| | off | 0 | off | Vb/2 |

a(1) = Va,
b(1) = Vb
a(2) = Va/2,
b(2) = Vb
a(3) = Va/2,
b(3) = Vb/2
a(4) = Va/4,
b(4) = Vb/2

TABLE 6

| LUMINANCE | Y ELECTRODE | | X ELECTRODE | |
|---|---|---|---|---|
| BIT | STATE | POTENTIAL | STATE | POTENTIAL |
| 1 | on | Va | on | −Vb |
| | off | 0 | off | Vb |
| 2 | on | Va | on | −Vb/2 |
| | off | 0 | off | Vb/2 |
| 3 | on | Va/2 | on | −Vb/2 |
| | off | 0 | off | Vb/2 |
| 4 | on | Va/2 | on | −Vb/4 |
| | off | 0 | off | Vb/4 |

a(1) = Va,
b(1) = Vb
a(2) = Va,
b(2) = Vb/2
a(3) = Va/2,
b(3) = Vb/2
a(4) = Va/2,
b(4) = Vb/4

As shown in Tables 1 and 3, only the voltage value of the Y electrode is changed in the first embodiment of the present invention. As shown in Table 2 and Tables 4 to 6, the voltage values of the X electrode and the Y electrode are changed in the second embodiment of the present invention. As understood from Tables 1 to 6, every a(k)xb(k) has the same values in the present invention. The product of a(k) and b(k) has a value expressed as $$a(k)\cdot b(k)=\text{consts } 2/2^{**}(k-1)$$

where consts 2 is an arbitrary const, 2**k(l) means a (k−1) power of 2, and k means a kth bit representing a density gradation level.

In Tables 1 to 6, the ratio between a(k) and b(k) is not especially prescribed. However, the ratio between a(k) and b(k) can be decided according to the display gradation level so that the difference between root-mean-square voltage values may be maximized. If maximum root-mean-square value contrast difference δC is defined as (1-minimum root-mean-square value/maximum root-mean-square value), the following ratio gives the maximum root-mean-square value contrast difference δC.

It is now assumed that the first embodiment of the present invention is used.

In case of a 4-level gradation display, we get the following equation by using characters shown in Table 1:

$$Va:Vb=\sqrt{(2M)}/\sqrt{5}:1 \quad \text{(eq. 17)}$$

where $$\delta C=1/(1+(\sqrt{(10M)})/3) \quad \text{(eq. 18)}$$

In case of a 16-level gradation display, we get the following equation by using characters shown in Table 3:

$$Va:Vb=2\sqrt{M}/\sqrt{85}:1 \quad \text{(eq. 19)}$$

where $$\delta C=1/(1+(2\sqrt{(85M)})/15) \quad \text{(eq. 20)}$$

It is now assumed that the second embodiment of the present invention is used.

In case of a 4-level gradation display, we get the following equation in the same way as the conventional technique by using characters shown in Table 2:

$$a(k):b(k)=Va:Vb=\sqrt{M}:1 \quad \text{(eq. 21)}$$

where $$\delta C=1/(1+\sqrt{M}) \quad \text{(eq. 22)}$$

In case of a 16-level gradation display, three kinds are shown in Tables 4 to 6.

In case of Table 4, we get the following equation in the same way as the conventional technique:

$$a(k):b(k)=Va:Vb=\sqrt{M}:1 \quad \text{(eq. 23)}$$

where $$\delta C=1/(1+\sqrt{M}) \quad \text{(eq. 24)}$$

In case of Tables 5 and 6, we get the following equation:

$$Va:Vb=\sqrt{(2M}/\sqrt{5}:1 \quad \text{(eq. 25)}$$

where $$\delta C=1/(1+(\sqrt{(10M)})/3) \quad \text{(eq. 26)}$$

If the parameters a(k) and b(k) are determined as shown in Table 4 in case of the second embodiment of the present invention, the parameter ratio is $\sqrt{M}$:1 in the same way as the conventional technique and the root-mean-square contrast difference also becomes identical with that of the conventional technique, even if the number of display gradation levels are increased. If the parameters a(k) and b(k) are determined as shown in Tables 5 and 6, the parameter ratio is $\sqrt{(2M)}/\sqrt{5}$:1 and the root-mean-square contrast difference also becomes $1/(1+(\sqrt{(10M)})/3)$ even if the number of display gradation levels are increased. As compared with the conventional technique, the root-mean-square contrast difference drops only slightly.

On the other hand, in case of the first embodiment of the present invention, the voltage value contrast difference decreases as the number of display gradation levels are increased. It is assumed, in general, that the number of display bits is n. In the first embodiment of the present invention, we get the following equation:

$$Va:Vb = \sqrt{(3n \cdot M/(2^{**}(2n)-1))}\ :1 \qquad \text{(eq. 27)}$$

where $$\delta C = 1/(1 + n \cdot M \cdot Vb/Va \cdot (2^{**}n - 1)) \qquad \text{(eq. 28)}$$

$\sqrt{(2M)}$ represents the square root of 2M, and M represents the number of horizontal lines of the liquid crystal display panel 100.

Assuming that the number of lines in the horizontal direction is 240, concrete numerical values will hereafter be given.

In the second embodiment of the present invention, the root-mean-square contrast difference δC becomes 0.0606 irrespective of the display bit length n under the condition shown in Table 4. Even under the conditions shown in Tables 5 and 6, the root-mean-square contrast difference δC is 0.0577 irrespective of the display bit length n, resulting in decrease of only 5%. On the other hand, in the first embodiment of the present invention, the root-mean-square contrast difference δC depends upon the display bit length n. In case of a 16-level gradation display with n=4, the root-mean-square contrast difference δC is 0.0499, resulting in decrease of as much as 18%. In case of a 64-level gradation display with n=6, the root-mean-square contrast difference δC is 0.0429, resulting in decrease of as much as 29%. As the root-mean-square contrast difference δC becomes larger, the dynamic range of the root-mean-square voltage value becomes large and it becomes possible to improve the contrast of the display image. The ratio of values of the parameters a(k) and b(k) is made equal to a ratio for maximizing a dynamic range of root-mean-square value of voltage in one frame interval or a ratio which is substantially equal, in practical use, to the ratio for maximizing the dynamic range.

As heretofore described, use of the method shown in Table 4 in the second embodiment of the present invention has an effect of preventing decrease of dynamic range of the root-mean-square voltage value. Use of the methods shown in Tables 5 and 6 in the second embodiment of the present invention has an effect of preventing the dynamic range of the root-mean-square voltage value from decreasing markedly by using simple steps of applied voltage value which do not include an irrational number.

In case the frequency is still high and crosstalk appears even if the embodiments heretofore described are used, it is possible to select a part of information sent from the outside and use it instead of using all of the information in order to reduce the frequency. For example, by selecting information corresponding to one picture for display during the time for sending information corresponding to two pictures from the outside, it is possible to display information corresponding to one picture in the display apparatus while information corresponding to two pictures is being sent outside. Various ways of information selection can be considered. For example, if data corresponding to one picture have been acquired, the next data are discarded. Alternatively, data acquisition and data discard may be conducted alternately in an interlaced scan form. Or data acquisition and data discard may be repeated alternately pixel by pixel. Alternatively, the average value of data corresponding to two pictures may be used.

One frame interval and one horizontal interval will now be redefined. One frame interval is defined as time required for displaying the information of one picture in the display apparatus. One horizontal interval is defined as the time of basic unit of the driving pulse for display of the case where a 2-level gradation display is made. Terms "One frame interval" and "one horizontal interval" used in claims are those redefined here. By thus redefining, it is possible to also cope with the case where the above described display information selection has been made and the case where the time of the basic unit of the driving pulse is made different in the active driving method from the time interval of the outside horizontal synchronizing signal. The reason will now be described. That is to say, in case of the active driving method, the basic unit of the driving pulse need not necessarily be the time obtained by dividing one frame interval by the number M of horizontal lines (which is equivalent to the time interval of the horizontal synchronizing signal). In case where M=240, for example, one frame interval may be divided by 256 facilitating generation of orthogonal base instead of dividing one frame interval by 240 or the horizontal and vertical directions may be interchanged.

A third embodiment of the present invention will now be described by referring to FIGS. 13 to 15. In case it becomes necessary to apply a voltage larger than the breakdown voltage of the circuit to each electrode of the liquid crystal panel 100, the applied voltage is lowered than the breakdown voltage by lengthening the application time. In the third embodiment, such a contrivance has been made.

Figure 13:
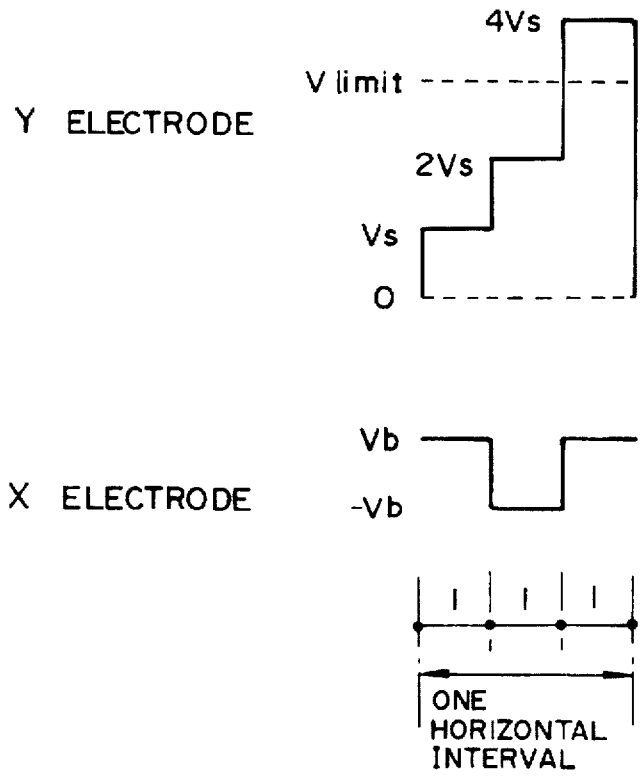
FIG. 13 is a diagram showing an example in which large amplitude value voltage of the present invention poses a problem.

FIG. 13 shows the case where there has occurred such a problem that a voltage which is at least the breakdown voltage Vlimit is supplied to a Y electrode of the liquid crystal panel 100. In FIG. 13, only one horizontal interval is taken out and a voltage value when the voltage of the Y electrode is in the on-state and an example of voltage value of an X electrode are shown. As evident from FIG. 13 as well, one horizontal interval was divided into three equal parts as in the first embodiment of the present invention and it was attempted to make an 8-level gradation display by using changes of the voltage value of the Y electrode. As a result, it became necessary to supply a voltage which is at least the breakdown voltage Vlimit of the circuit to the Y electrode. That is to say, voltages represented as Vs:2Vs:4Vs were supplied to the Y electrode to form differences represented as 1:2:4 in root-mean-square voltage value. However, it followed that 2Vs<Vlimit<4Vs and the voltage having a large amplitude value of 4Vs became necessary.

Figure 14:
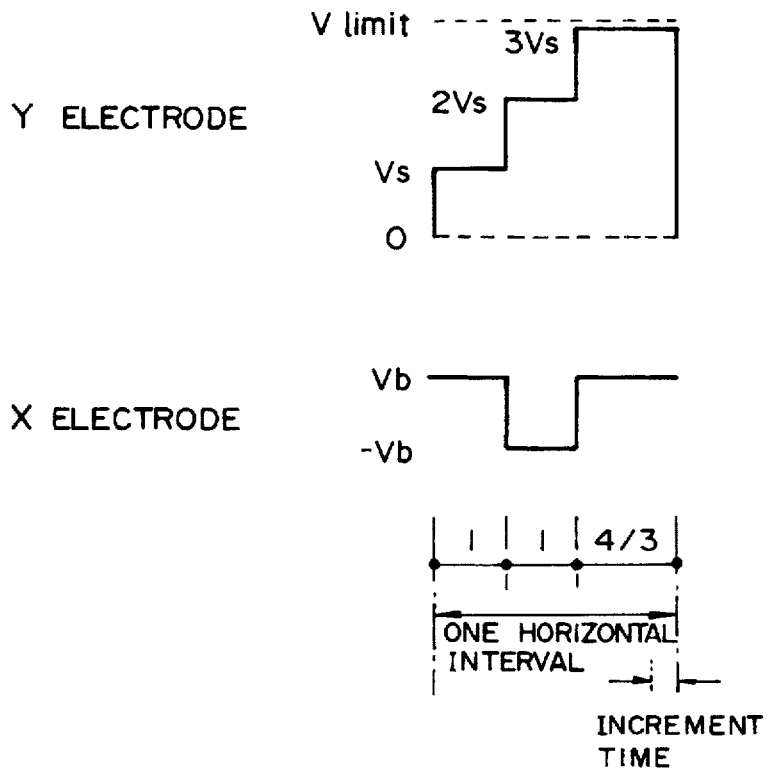
FIG. 14 is a diagram showing an example of a measure to counter the large amplitude value voltage of the present invention.
Figure 15:
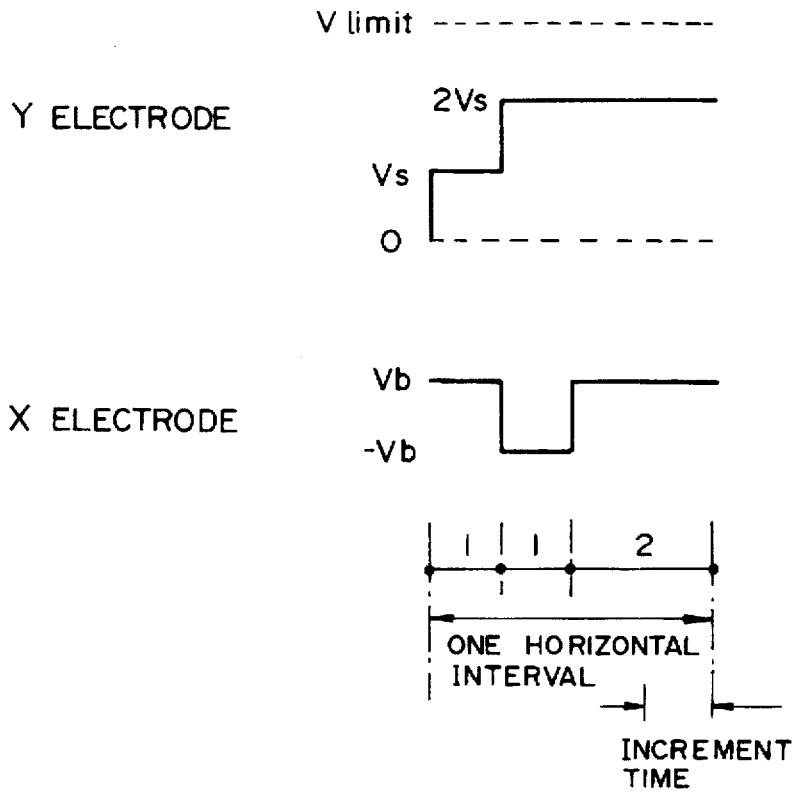
FIG. 15 is a diagram showing another example of a measure to counter the large amplitude voltage of the present invention.

In FIGS. 14 and 15, the voltage value of the large amplitude shown in FIG. 13 is made smaller than the breakdown voltage Vlimit by lengthening the application time. In FIG. 14, one horizontal interval is divided according to ratios 1:1:4/3 and applied voltage is defined as Vs:2Vs:3Vs so that voltage smaller than the breakdown voltage may suffice. In FIG. 15, one horizontal interval is divided according to ratios 1:1:2 and applied voltage is defined as Vs 2Vs:2Vs.

Besides them, there are a large number of combinations having the same product of the voltage value of the Y electrode and the application time. Furthermore, not only in the case where display gradation level weighting is implemented by using only the voltage applied to the Y electrode as in the first embodiment of the present invention but also in the case where the voltage applied to the X electrode is changed as in the second embodiment of the present invention, it is possible to avoid the applied voltage having a large amplitude in the same way by conducting deformation so that the product of the voltage applied to the X electrode, the voltage applied to the Y electrode, and the application time may coincide.

In the examples of FIGS. 14 and 15 heretofore described, the time interval of one horizontal interval has been lengthened. In case the duration of one horizontal interval cannot be lengthened, however, it is possible to make the time interval of one horizontal interval identical by shortening time uniformly while keeping the ratio unchanged. That is to say, in FIG. 14, one horizontal interval is divided according to the ratio of 1:1:4/3. If this ratio is represented by the original time scale having 1:1:1, we get 9/10: 9/10:12/10. Therefore, by dividing one horizontal interval according to the ratio of 9/10:9/10:12/10, duration of the horizontal interval can be made identical with the original value.

Heretofore, three examples of embodiments of the present invention have been described. They will be now rearranged and described hereafter.

In order to make a gradation display based upon n-bit display data, the present invention divides time within one frame interval by a number r which is at least n and supplies voltages expressed by the following equations to respective electrodes of the liquid crystal panel 100.

$$Y(j,g,t) = a(g) \cdot \phi(j,g,t) \quad \text{(eq. 29)}$$

$$X(i,g,t) = b(g) \cdot \sum_{j=1}^{M} I(i,j,g) \cdot \phi(j,g,t) \quad \text{(eq. 30)}$$

In these equations, i and j indicate the order in the matrix of the liquid crystal panel 100.

The character g is the order assigned to sections obtained by dividing time into r parts and g assumes an integer value ranging from 1 to r.

The character t represents time counted for each of noticed sections.

Y(j,g,t) is a voltage waveform generated by the jth Y driving circuit at the gth time t, and it becomes a voltage waveform applied to the jth row of the liquid crystal panel 100.

X(i,g,t) is a voltage waveform generated by the ith X driving circuit at the gth time t, and it becomes a voltage waveform applied to the ith row of the liquid crystal panel 100.

Characters a(g) and b(g) are parameter values, and at least one of them depends upon g.

J(i,j,g) is a value based upon display data of the ith row of the jth column in the matrix of the liquid crystal panel 100. If the matrix intersection of the ith row of the jth column in the gth time-divided section is to be provided with a high root-mean-square voltage value, J(i,j,g) has a value of −1. If the matrix intersection is to be provided with a low root-mean-square voltage value, J(i,j,g) has a value of 1. $\phi$(j,g,t) is an orthogonal function having a constant norm. That is to say, $$\int dt\phi(i,g,t)\phi(j,g,t)=0 \; i\neq j$$

$$\int dt\phi(i,g,t)\phi(j,g,t)=\text{constant} \; i=j$$

where the integration range covers the whole of the noticed gth time-divided section in one frame interval.

If voltages expressed by the above described equations 29 and 30 are applied to respective electrodes of the liquid crystal panel 100, then one of two states having different root-mean-square voltage values can be realized depending upon whether the value of J(i,j,g) is −1 or 1 for each of sections resulting from division by r. If difference between two root-mean-square voltage values varies from divisional section to divisional section, typically 2**r different root-mean-square voltage states can be produced by combining them. However, when there are sections having the same root-mean-square voltage difference or the root-mean-square voltage difference of a certain section can be represented by a combination of root-mean-square voltage difference values of other sections, the number of combinations which can be represented by the whole is reduced by that amount.

In the conventional equally divided pulse width modulation, the number of divisions r was m−1 and uniform time division was conducted, where m was the number of display gradation levels. Furthermore, a(g) and b(g) were made constant irrespective of the divisional section g, and the root-mean-square voltage difference was made identical in all divisional sections. Although the number of divisions was m−1, therefore, m combinations could be displayed. The number of display gradation levels m was 2**n. As n became large, the number of divisions (m−1) became an enormous number. As a result, the minimum time resulting from time division became short and the frequency band in use became large.

In the conventional weighted pulse width modulation, the number of divisions was made equal to n. Time intervals were weighted with 1:2:4: . . . : 2(n−1). In the same way, root-mean-square voltage difference values of respective divisional sections were decided to be 1:2:4: . . . : 2(n−1). Thus 2**n combinations were made possible. However, since the minimum time interval was the same as that of the conventional equally divided pulse width modulation, the frequency band in use became large.

The present invention has a feature that the number of divisions has a value of n or a value larger than n and close to n, and the time intervals of respective divisional sections are made even as far as possible to limit the frequency band. At that time, root-mean-square voltage difference of each divisional section is determined and values of a(g) and b(g) and the divisional time are adjusted so that all of desired gradation levels may be represented. Representing the time interval of each divisional section as t(g), the root-mean-square voltage difference of each divisional section is in proportion to the value of a(g)*b(g)*t(g). By using this relation, values of a(g), b(g) and t(g) suiting the occasion can be determined. In the first embodiment of the present invention, the case where time is divided into n equal parts and the value of a(g) is adjusted to obtain a desired root-mean-square voltage value has been illustrated. In the second embodiment, the case where time is divided into n equal parts in the same way and values of a(g) and b(g) are adjusted has been illustrated. In the third embodiment, an example in which the value of t(g) is adjusted to prevent a(g) which would otherwise exceed the circuit breakdown voltage from exceeding the breakdown voltage has been illustrated. Besides them, there are numerous concrete adjustment values using the fact that the root-mean-square voltage difference is in proportion to a(g)*b(g)*t(g). As for the adjustments of a(g), b(g) and t(g), they are made beforehand and then fixation is performed. Alternatively, conditions may be determined and adjustments may be made every time on the basis of the conditions. In case adjustments are made every time, it is necessary to make corrections corresponding to constants afterwards in order to make not only the root-mean-square voltage difference values but also root-mean-square voltage values themselves equal to predetermined values.

In the present invention, when the relation between the root-mean-square voltage and display luminance is linear, the number of divisions is n and respective divisional sections are associated with display bits so that root-mean-square voltage difference values of respective divisional sections may have weights meant by display bits. When the relation between the root-mean-square voltage and display luminance is nonlinear, some cases cannot be coped with by the number of divisions n and at that time it is necessary to increase somewhat the number of divisions. In addition, it is in some cases impossible to associate divisional sections with display bits. Therefore, a bit train for driving each divisional section is produced, and the display bit train is transformed into a driving bit train. On the basis of resultant bit train for driving, driving is conducted. Representing bit trains by using expression of sets, a display bit train on the matrix i,j is represented as $\{I(i,j,k)|k=1,n\}$, and a driving bit train is represented as $\{J(i,j,g)|(g=1,r\}$. Association of I(i,j,k) with J(i,j,g) may be conducted by referring to a memory table for a relation derived beforehand. Alternatively, calculations may be performed every time by giving a relation. Further alternatively, instead of producing concretely the bit train for driving, values may be derived and used every time for each of divisional sections. The case where the root-mean-square voltage corresponding to the display luminance is obtained in one frame interval has been described here. Alternatively, the root-mean-square voltage corresponding to the display luminance may be obtained in several frame intervals in the same way. In that case, just the same may be said by redefining several frames in a lump as one new frame interval.

In order to explain the driving method for giving gradation representation to the liquid crystal display apparatus of simple matrix type, description has heretofore been given laying stress on the driving pulse waveform of voltage applied to the liquid crystal panel 100. As for a liquid crystal display apparatus for implementing the method of the present invention, embodiments of its configuration and operation will hereafter be described in detail by referring to drawing. The case where the driving waveform shown in FIG. 1 is supplied to the liquid crystal panel 100 in the block configuration of the display apparatus shown in FIG. 2 will hereafter be described.

FIG. 2 is a block configuration diagram of a liquid crystal display apparatus of the present invention. On the basis of FIG. 2, the outline of operation will hereafter be described. The vertical synchronizing signal, horizontal synchronizing signal, and data clock are inputted to the timing signal generation circuit 104. The timing signal generation circuit 104 generates various timing signals for operating a display data control circuit 105, the X driving circuit 101, the Y driving circuit 102, and the voltage generation circuit 103. Numeral 301 denotes a voltage generation circuit timing bus. Numerals 302 and 303 denote a Y driving circuit timing bus and an X driving circuit timing bus, respectively. Numeral 304 denotes a display data timing bus. Numeral 305 denotes X data, which is 4-dot parallel data. The display data control circuit 105 takes in display data corresponding to one line, separates the data into respective bits representing gradation levels, and supplies them to the X driving circuit 101 as the X data 305. Numeral 306 denotes X voltage and 307 denotes Y voltage. The X voltage and Y voltage are respectively passed through as many parallel buses as is needed and respectively have a plurality of voltage values. The voltage generation circuit 103 generates a plurality of desired voltages from reference voltage by using a voltage divider circuit and supplies a plurality of desired voltages to each of the X driving circuit 101 and the Y driving circuit 102 as the X voltage 306 and Y voltage 307. On the basis of the X data sent from the display data control circuit 105 and various timing signals sent from the timing signal control circuit 104, the X driving circuit 101 and the Y driving circuit 102 select desired voltages and apply the desired voltages to respective intersections of the matrix of the liquid crystal panel 100.

Although not illustrated herein, the reference voltage means power supply voltage inputted to the liquid crystal display apparatus. By understanding the operation of the display data control circuit 105, the X driving circuit 101, the Y driving circuit 102, and the voltage generation circuit 103 which will be described later, the timing signal generation circuit 104 can be easily implemented by using general purpose logic circuits used in TTL circuits.

Figure 16:
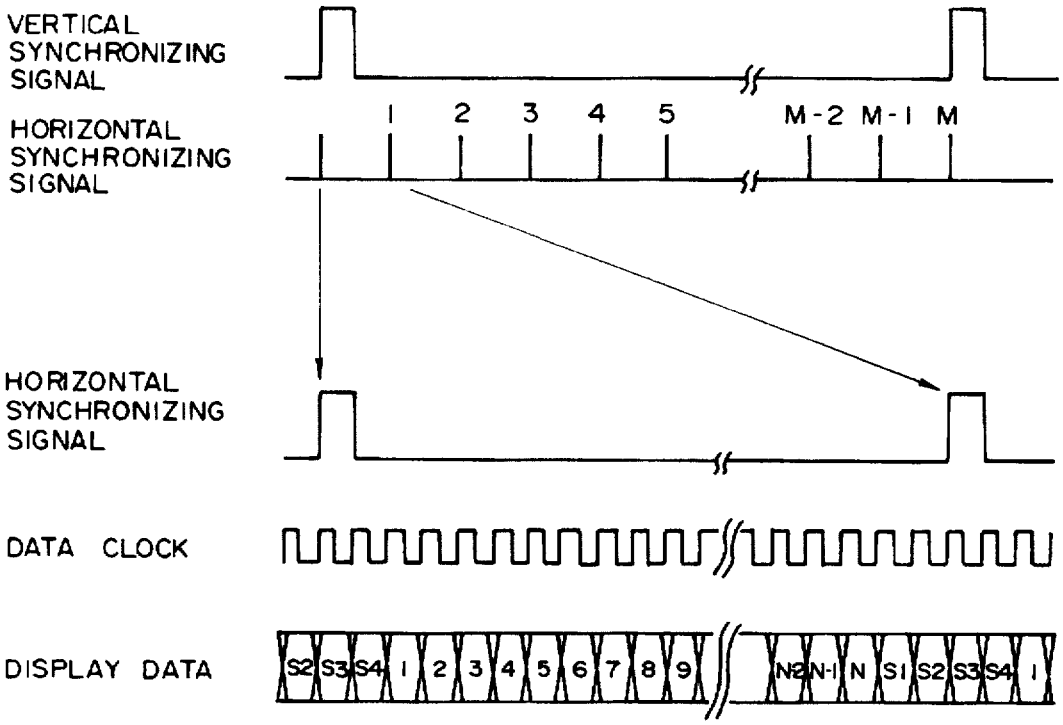
FIG. 16 is a timing diagram of signals inputted to a liquid crystal display apparatus.

FIG. 16 is a timing diagram showing the timing of the vertical synchronizing signal, horizontal synchronizing signal, data clock, and display data, which are inputted to the liquid crystal display apparatus. Assuming now that a display is made by using N columns and M lines and there are no vertical retrace line intervals including lines not displayed, one period of the vertical synchronizing signal in one frame interval corresponds to M periods of the horizontal synchronizing signal. During one period of the horizontal synchronizing signal, data corresponding to one line are inputted in synchronism with the data clock. It is now assumed that the horizontal retrace line interval including lines not displayed includes 4 dots. The four dots are denoted by S1 to S4 in FIG. 16, and data of displayed N columns are denoted by 1 to N. The display data are 2-bit data indicating a 4-level gradation display and are serially inputted.

Figure 17:
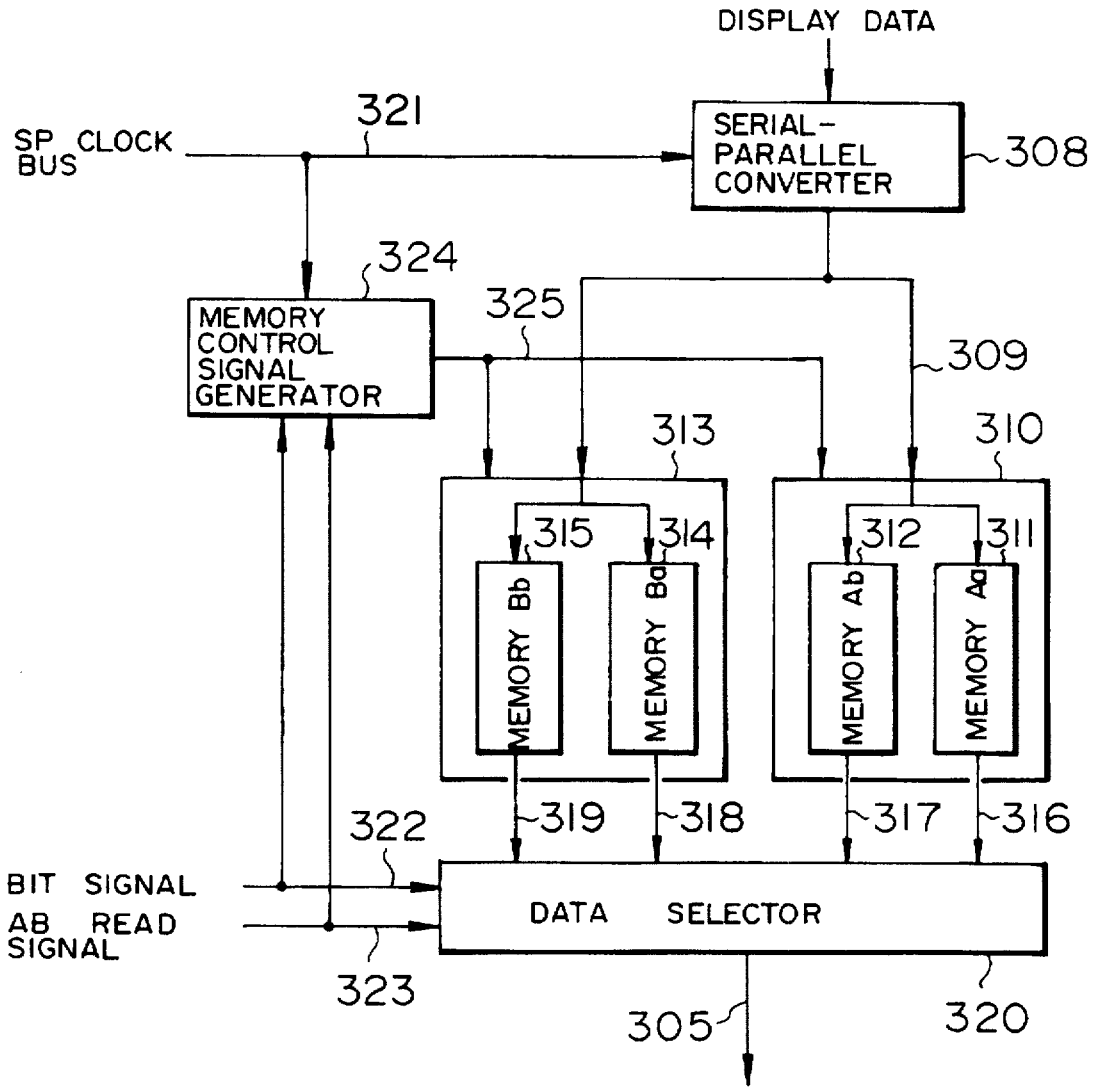
FIG. 17 is a block diagram of an embodiment of a display data control circuit.

FIG. 17 is a block diagram of an embodiment of the display data control circuit 105. Numeral 308 denotes a serial-parallel converter, and 309 denotes parallel display data. Numeral 321 denotes a SP clock bus. By the SP clock bus, the inputted serial display data are converted to 4-dot parallel display data 309. Data are converted to a parallel form with "1" of data to be displayed and denoted by "1" to "N" in FIG. 16 at the head. This serial-parallel converter 308 latches the serial display data corresponding to parallel data, here 4 dots by using the clock synchronized with the serial display data and latches the data thus latched by using a parallel clock in order to generate parallel display data 309. Therefore, the SP clock bus 321 carries the serial clock and parallel clock synchronized with the above described serial display data. The parallel clock is generated by conducting frequency division upon the frequency clock. Here, the parallel clock is generated at 4-dot periods with such timing that data denoted by "1" in FIG. 16 is handled as the head data.

Numeral 310 denotes a memory unit A. Numeral 311 denotes a memory Aa, and 313 denotes a memory Ab. Numeral 313 denotes a memory unit B. Numeral 314 denotes a memory Ba, and 315 denotes a memory Bb. Numerals 316 to 319 denote read data of the memory Aa 311, memory Ab 312, memory Ba 314, and memory Bb 315, respectively. That is to say, numerals 316 to 319 denote data Aa, data Ab, data Ba, and data Bb, respectively. The parallel display data 309 are written alternately into the memory unit A and memory unit B line by line. Data are read from a memory unit for which writing is not being conducted and X data 305 is generated. Numeral 320 denotes a data selector. Numeral 322 denotes a bit signal for indicating whether the high-order bit of the read data is made effective or low-order bit is made effective. Numeral 323 denotes an AB read signal for indicating whether data should be read from the memory unit A 310 or data should be read from the memory unit B 313. In accordance with the bit signal 322 and the AB read signal 323, the data selector 320 selects one out of the data Aa 316, data Ab 317, data Ba 318, and data Bb 319, and outputs it as the X data 305. Numeral 324 denotes a memory control signal generator. Numeral 325 denotes a memory read-write signal bus. The memory control signal generator generates a signal on the memory read-write signal bus 325 from the signal on the SP clock bus 321, the bit signal 322, and the AB read signal 323. Although details are not described here, they are self-evident from the read operation and write operation of memories. The signal on the SP clock bus 321, the bit signal 322, and the AB read signal 323 are generated by the timing signal generation circuit 104 as signals on the display data timing bus 304 and supplied to the display data control circuit 105.

Figure 18:
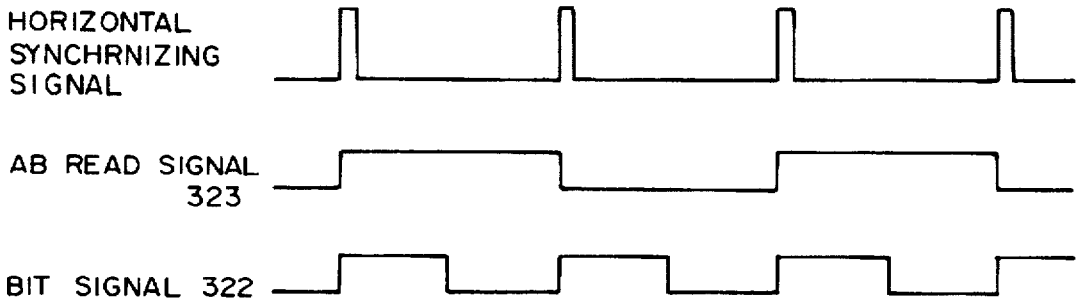
FIG. 18 is a timing diagram of memory read timing.

FIG. 18 is a timing diagram for explaining the read timing of the memories. Table 7 is a table for explaining the operation of the data selector 320. Their timing and operation will be clear from FIG. 18 and Table 7.

TABLE 7

| AB READ SIGNAL 323 | BIT SIGNAL 322 | X DATA 305 |
|---|---|---|
| 1 | 1 | DATA Aa 316 |
| 1 | 0 | DATA Ab 317 |
| 0 | 1 | DATA Ba 318 |
| 0 | 0 | DATA Bb 319 |

Figure 19:
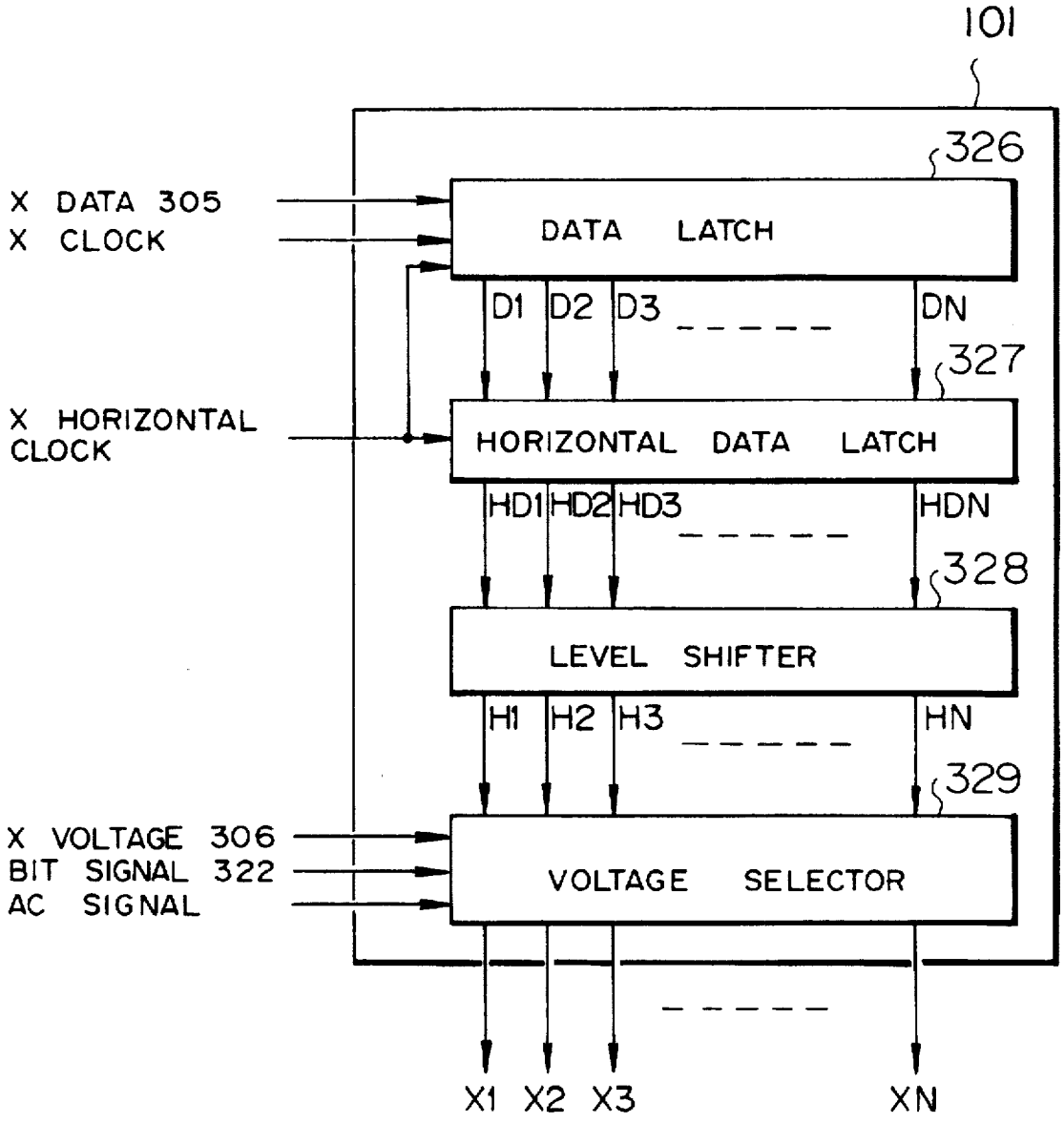
FIG. 19 is a block diagram of an embodiment of an X driving circuit.

FIG. 19 is a block diagram of an embodiment of the X driving circuit 101. Numeral 326 denotes a data latch for successively latching the X data 305 in response to an X clock. The data latch 326 is reset by an X horizontal clock. Thereafter, the X data 305 corresponding to one line are taken in successively from the head, and data D1 to DN are outputted. Numeral 327 denotes a horizontal data latch responsive to the X horizontal clock to take in simultaneously data D1 to DN corresponding to one line taken in the data latch 326. The horizontal data latch 327 outputs the data thus taken in as horizontal data HD1 to HDN. Numeral 328 denotes a level shifter and 329 denotes a voltage selector. The level shifter 328 converts the horizontal data HD1 to HDN outputted from the horizontal data latch 327 and provided with TTL voltage levels to voltage levels handled by the voltage selector. As an example, the level shifter 328 converts the TTL level of 5 V to a high breakdown voltage level of 28 V. The converted data corresponding to one line are outputted as shift data H1 to HN. In accordance with the shift data H1 to HN corresponding to one line, the bit signal 322, and an alternating current signal, the voltage selector 329 selects one voltage from the X voltage 306 and outputs it. In the same way as the shift data H1 to HN, the voltage selector 329 shifts the voltage levels of the bit signal 322 and the alternating current signal and uses them. The X clock, X horizontal clock, bit signal 322, and alternating current signal are generated by the timing signal generation circuit 104 as the signals on the X driving circuit timing bus 303 and supplied to the X driving circuit 101. Table 8 is a table for explaining the operation of the voltage selector 329. How to select voltage will be obvious from Table 8.

Figure 20:
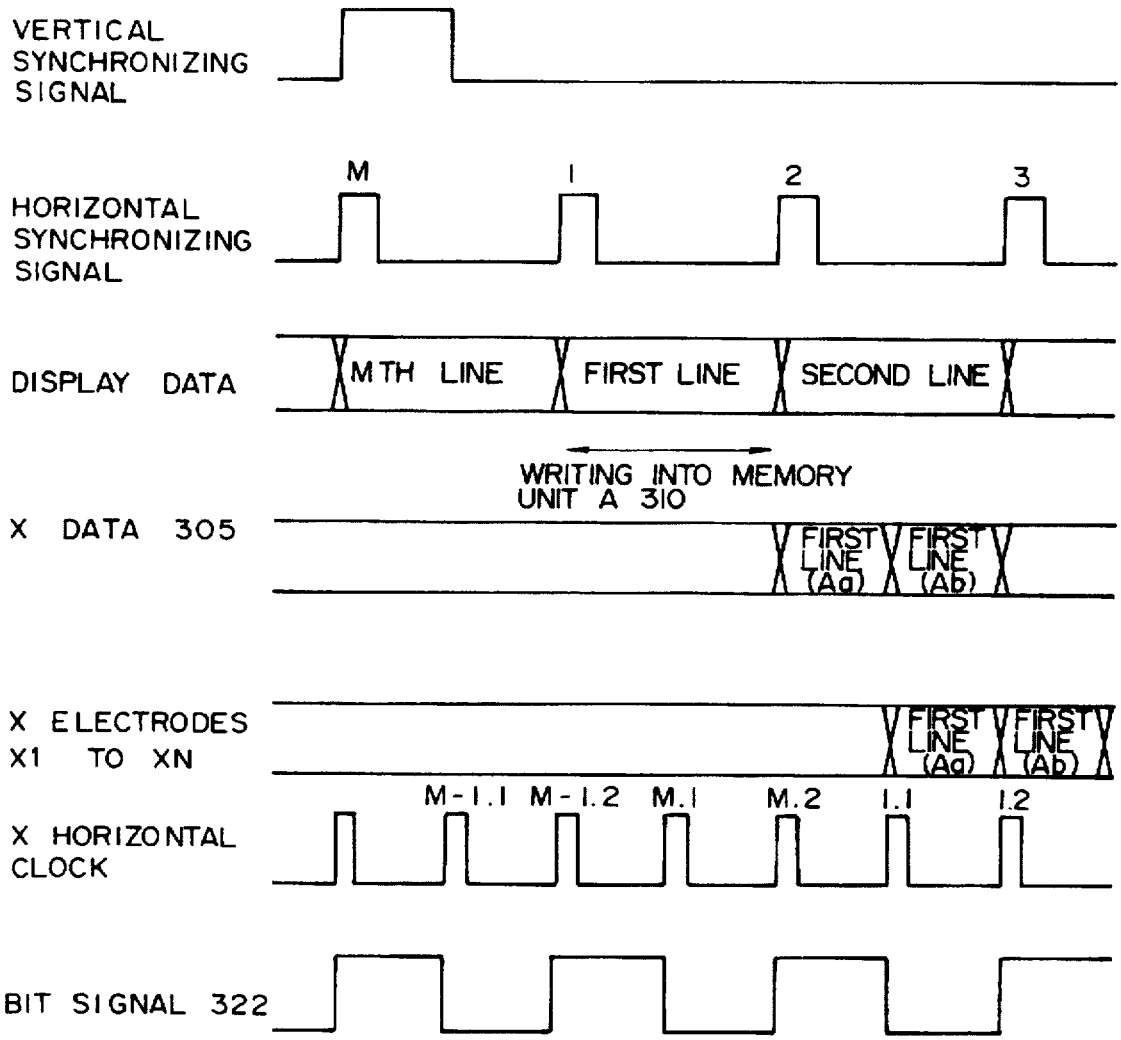
FIG. 20 is a timing diagram showing the stream of display data.
Figure 21:
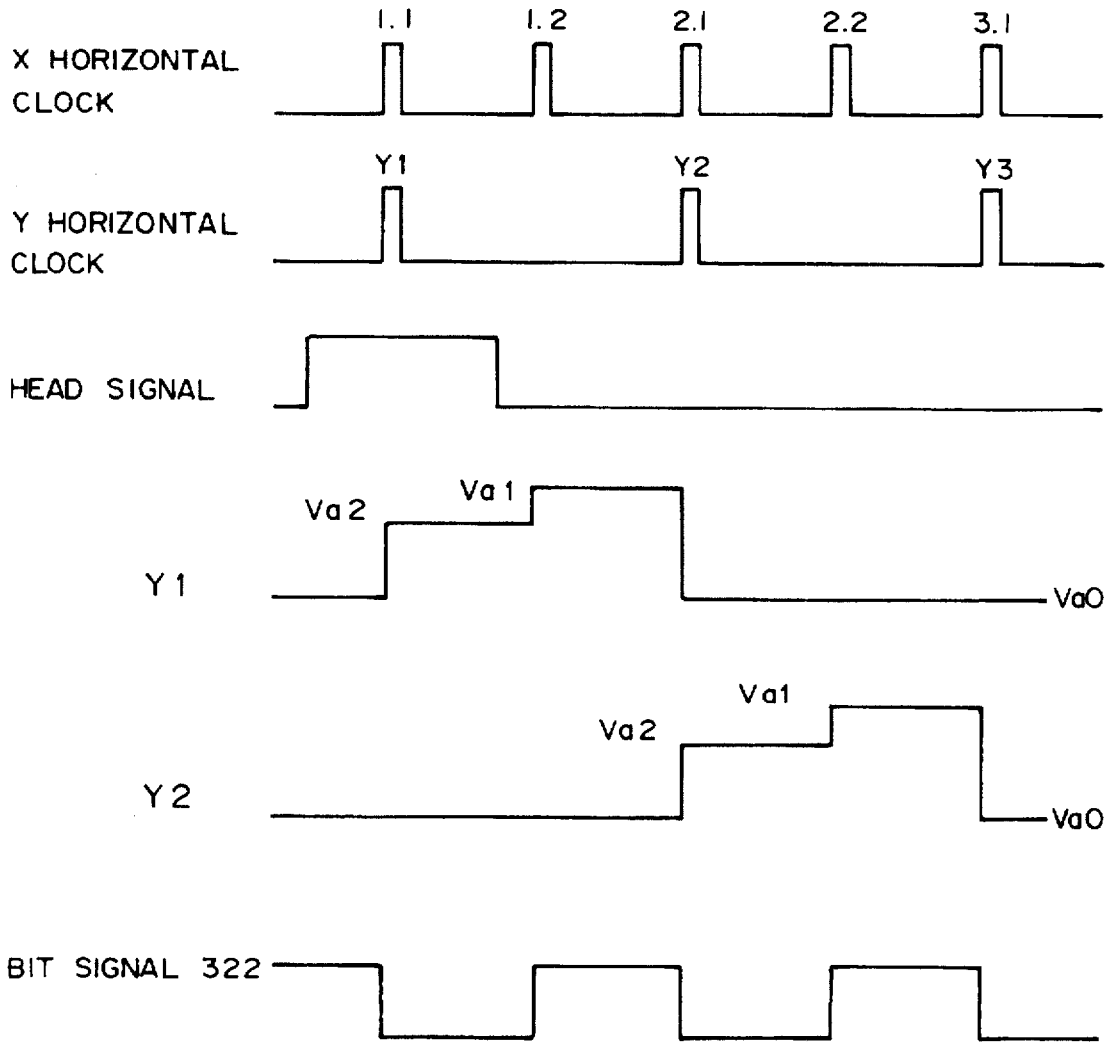
FIG. 21 is a timing diagram of the operation of a Y driving circuit.

FIG. 20 is a timing diagram for explaining the timing until the inputted display data are supplied to the liquid crystal panel 100. FIG. 21 is a timing diagram for explaining the operation of the Y driving circuit 102. Their operation and timing will be obvious from FIGS. 20 and 21.

TABLE 8

| AC SIGNAL | BIT SIGNAL 322 | DATA | SELECTED VOLTAGE |
|---|---|---|---|
| 1 | 0 | 0 | Vb1 |
| 1 | 0 | 1 | Vb2 |
| 1 | 1 | 0 | Vb3 |
| 1 | 1 | 1 | Vb4 |
| 0 | 0 | 0 | Vb5 |
| 0 | 0 | 1 | Vb6 |
| 0 | 1 | 0 | Vb7 |
| 0 | 1 | 1 | Vb8 |

Figure 22:
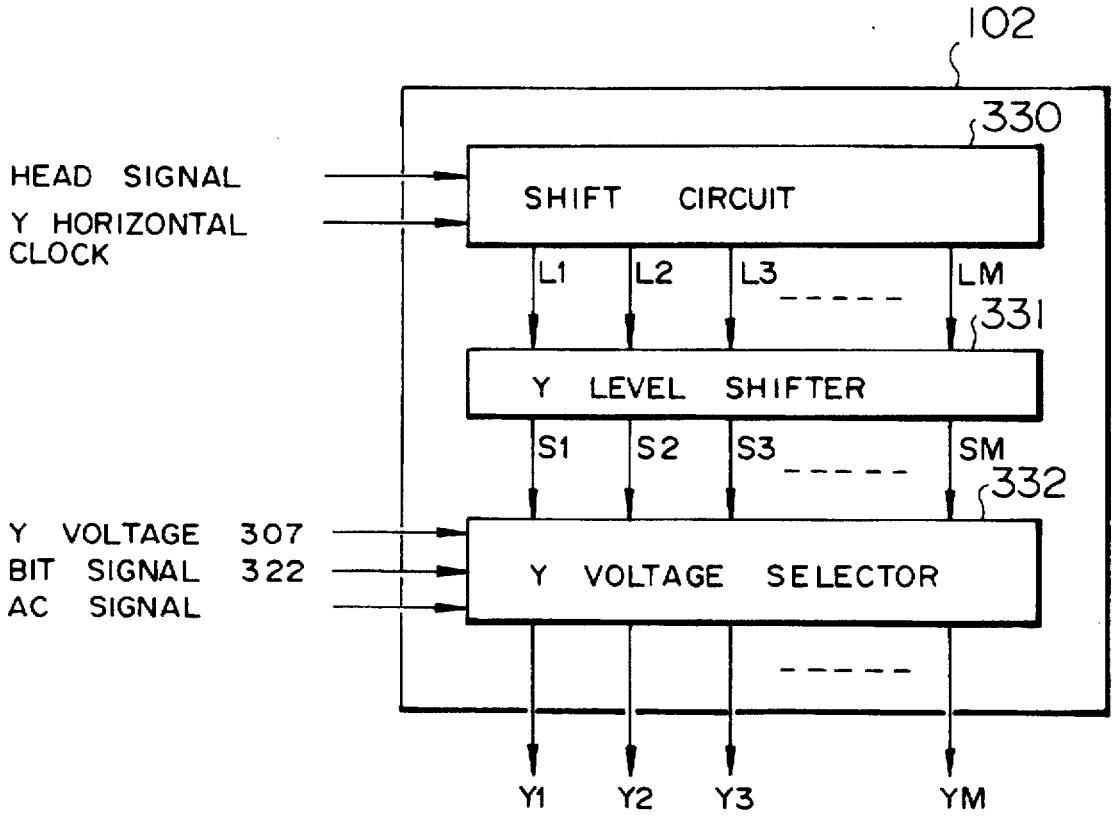
FIG. 22 is a block diagram of an embodiment of the Y driving circuit.

FIG. 22 is a block diagram of an embodiment of the Y driving circuit 102. Numeral 330 denotes a shift circuit. Numeral 331 denotes a Y level shifter, and 332 denotes a Y voltage selector. In response to the Y horizontal clock, the shift circuit 330 takes in the head signal and makes line data L1, which is data of the first line, have a logic "1". Thereafter, the shift circuit 330 shifts this "1" to line data L2, L3, . . . LM in response to the Y horizontal clock. The Y level shifter 331 shifts the TTL voltage level of the line data L1 to LM to the voltage level of the Y voltage selector 332. The shifted data are outputted as shift line data S1 to SM. In accordance with the shift line data S1 to SM, the bit signal 322, and the alternating current signal, the Y voltage selector 332 selects one voltage from the Y voltage 307. Table 9 is a table for explaining the operation of the Y voltage selector 332. In Table 9, * indicates that it does not matter whether the data may be "1" or "0".

Operation of the embodiment of the present invention will hereafter be described by referring to drawing.

In the liquid crystal display apparatus of FIG. 15, display data are inputted at timing shown in FIG. 16. During one frame interval, 2-bit gradation data corresponding to one picture are serially sent in order. The display data are inputted to the display data control circuit 105. In the display data control circuit 105, the display data are converted to 4-bit parallel display data 309 as shown in FIG. 17. The parallel display data 309 are written into the memory unit A 310. At this time, the low-order bit of the gradation bits having 2 bits is written into the memory Aa 311, whereas the high-order bit is written into the memory Ab 312. If data corresponding to one line have been written into the memory unit A 310, the data corresponding to the next one line are written into the memory unit B 313. As for writing into the memory unit B 313 as well, the low-order bit of the gradation bits is written into the memory Ba 314, whereas the high-order bit is written into the memory Bb 315 in the same way as the memory unit A 310. As for writing, these operations are repeated alternately. As for reading from the memory units, display data corresponding to one line are read out from a memory unit for which writing is not being conducted, twice at a speed which is twice the writing speed. In the present embodiment, this can be implemented by using a clock period synchronized with 4-dot parallel data for writing and using a clock period synchronized with 2-dot parallel data. Assuming now that display data of the second line is being written into the memory unit B 313, therefore, display data of the first line is read from the memory unit A 310. As shown in FIG. 18, this reading operation is conducted twice during one horizontal interval. In the first time, the bit signal 322 becomes "1". In the second time, the bit signal 322 becomes "0". The AB read signal 323 indicates reading from the memory unit A 310 when it is "1", and indicates reading from the memory unit B 313 when it is "0". As shown in Table 7, therefore, data thus read out are selected by the data selector 320 to become the X data 305.

In the display data control circuit 105 of FIG. 15, therefore, the display data is separated into respective bits representing gradation levels and outputted as the X data 305 one horizontal line at a time. The X data 305 is supplied to the X driving circuit 101.

An embodiment of the X driving circuit 101 and its operation will now be described.

The X driving circuit 101 can be realized by the configuration shown in FIG. 19. In response to the X clock, the X data 305 is taken in the data latch 326. If display data corresponding to one horizontal line are taken in, the display data are taken in the horizontal data latch 327 in response to the X horizontal clock to become the horizontal data HD1 to HDN. In accordance with the shift data Hi to HN obtained by shifting voltage levels of the horizontal data HD1 to HDN, the bit signal 322, and the alternating current signal, the voltage selector selects one voltage from the X voltage 306 as shown in table 8 and outputs it to the X electrodes X1 to XN. In Table 8, the bit signal 322 indicates the low-order bit when it is "1" and indicates the high-order bit when it is "1" in contrast with reading from the memory unit. This is because display data are subject to a delay of one horizontal interval of the X horizontal clock in the X driving circuit. As compared with Table 2, the voltage level Vb1 in Table 8 0becomes VB/$\sqrt{2}$. In the same way, Vb2, Vb3, Vb4, Vb5, Vb6, Vb7 and Vb8 become −VB/$\sqrt{2}$, Vb, −Vb, −VB/$\sqrt{2}$, VB/$\sqrt{2}$, −Vb and Vb, respectively. As compared with Table 1, Vb1, Vb2, Vb3, Vb4, Vb5, Vb6, Vb7 and Vb8 become Vb, −Vb, Vb, −Vb, −Vb, Vb, −Vb, and Vb, respectively. In the present embodiment, therefore, the voltage selector selects one voltage from 8 voltage values. As described in the aforementioned voltage examples, the number of required different voltage values is 4 when compared with Table 2 and the number of required different voltage values is 2 when compared with Table 1. Therefore, the selection operation can be implemented by selecting one voltage value from 4 voltage values or 2 voltage values in voltage selection and decoding the shift data H1 to HN, the alternating current signal, and the bit signal 322 to form a selection signal. Thereby, it becomes possible to reduce the number of voltage selections, resulting in an effect of reducing the cost of the X driving circuit 101.

An embodiment of the Y driving circuit 102 and its operation will now be described.

The inputted display data will now be described. As heretofore described, the display data of the first line indicated by a horizontal synchronizing signal generated after the vertical synchronizing signal has been outputted is temporarily written into a memory unit such as the memory unit A 310 as shown in FIG. 20 and read out in the next horizontal interval. With a period of the X horizontal clock equivalent to half of one horizontal interval, the display data thus read out are separated into low-order bits corresponding to one horizontal line and high-order bits corresponding to one horizontal line, the X data 305 being thus produced. The X data 305 is subjected to a delay of one period of the X horizontal clock in the X driving circuit 101 and outputted to the liquid crystal panel 100 as the voltage of the X electrode. As evident from the foregoing description, the Y horizontal clock and the head signal have the timing as shown in FIG. 21. This aims at outputting voltage Va2 and Val to Y1, which is the Y electrode of the first line, while the X driving circuit 101 is outputting voltage determined by the display data of the first line (the first line (Aa) and the first line (Ab) of the X electrode in FIG. 20). In the present embodiment, therefore, the Y horizontal clock is outputted at such timing that the X horizontal clock of 1.1, 2.1, 3.1, . . . N.1 is outputted. The head signal becomes a signal of such timing that "1" can be latched at timing of the Y horizontal signal indicated by Y1 of FIG. 21. As shown in FIG. 21, the Y driving circuit 102 shifts the voltage output Va2 and Val successively to Y1, Y2, . . . YM in response to the Y horizontal clock. When the Y driving circuit 102 outputs neither the voltage of Va2 nor the voltage of Val, it outputs voltage of Va0. Hereafter, an embodiment of this Y driving circuit 102 will be described by referring to FIG. 22. The shift circuit 330 takes in "1" of the head signal in response to the Y horizontal clock, "1" thus appearing in the line data L1. Thereafter, the shift circuit 330 shifts "1" successively to L2, L3, . . . . LM in response to the Y horizontal clock. Since the head signal becomes "1" once every frame, line data other than line data being "1" become "0". The line data L1 to LM are shifted in voltage level by the Y level shifter, resulting in the shift line data S1 to SM. In accordance with the shift line data S1 to SM, the bit signal 322, and the alternating current signal, the Y voltage selector selects one voltage value from the Y voltage 307 as shown in Table 9.

TABLE 9

| AC SIGNAL | BIT SIGNAL | DATA | SELECTED VOLTAGE |
|---|---|---|---|
| 1 | 0 | 1 | Va2 |
| 1 | 1 | 1 | Val |
| * | * | 0 | Va0 |
| 0 | 0 | 1 | −Va2 |
| 0 | 1 | 1 | −Val |

As compared with Tables 1 and 2, the voltage level Val in Table 9 becomes Va. In the same way, Va2 and VaO become Va/$\sqrt{2}$ and "0", respectively.

As heretofore described, it is possible to realize such a liquid crystal driving circuit that one horizontal interval is divided into two parts and a 4-level gradation display is made by the operation of the display data control circuit 105, x driving circuit 101, and Y driving circuit 102. In the present embodiment, gradation bits of the display data have been divided every horizontal line. However, the present invention is not limited to this. The division may be performed every arbitrary number of horizontal lines, or it may be performed by taking a frame as the unit. It can be easily inferred that this can be realized by increasing the storage capacity of the memory unit of the display data control circuit 105 to the capacity corresponding to its control unit.

In case the number of display gradation levels is to be increased, it can be done by increasing the memory capacity for storage by an amount corresponding to increased bits and making the reading period of the memory unit equal to the product of the number of bits and the period of writing operation. This can also be easily inferred from the present embodiment. In case the number of display gradation levels is to be further increased, the number of voltage values outputted from the X driving circuit 101 and the Y driving circuit 102 increases as shown in Tables 3 to 6. This is accomplished by increasing the number of selection voltage values of the respective voltage selectors as easily inferred from the present embodiment. In case the number of display gradation levels has been increased, the period of reading operation of the memory unit becomes the product of the number of bits and the period of writing. Therefore, the amount of data of the bit signal 322 also increases. (In the present embodiment, there are data of "1" and "0" because of twice reading operation.) By using this, therefore, selection of an increased number of voltage values is made possible.

In the foregoing description, the voltage generation circuit 103 only generates a plurality of desired voltage values. The role of selecting desired voltage values applied to each intersection of the matrix of the liquid crystal panel 100 is played in only the X driving circuit 101 and Y driving circuit 102. However, the above described voltage selector may be implemented in other ways. For example, the voltage generation circuit 103 may also bear a part of the function of the voltage selector by using the fact that the number of voltage values applied to the above described matrix in a fixed time is limited. In this method, the timing signal generation circuit 104 generates timing signals and sends necessary timing information to the voltage generation circuit 103 via the voltage generation circuit timing bus 301. The voltage generation circuit 103 produces as many desired voltage values as is needed for the timing or switches them and output them. In the X driving circuit 101 and the Y driving circuit 102, desired applied voltage values are selected from only as many voltage values as is needed for the timing. Alternatively, a similar function may be implemented by disposing circuits each having a voltage selection function respectively between the voltage generation circuit 103 and the X driving circuit 101 and between the voltage generation circuit 103 and the Y driving circuit 102. Such a method that the voltage generation circuit 103 supplying voltage also bears a part of function of the voltage selector brings about an effect of reducing the number of buses supplying a plurality of voltage values of the X voltage 306 and the Y voltage 307 and an effect of reducing bits of data providing information for determining the applied voltage values of the X driving circuit 101 and the Y driving circuit 102.

Heretofore, embodiments of the present invention have been described by referring to a liquid crystal display apparatus. The material need not necessarily be liquid crystal. Alternatively, it is possible to use such a material as to change the transmittivity, reflectance, or polarization factor of light, or change spectrum distribution of transmittivity, reflectance, or polarization factor including the spectrum of light color. That is, the present invention uses a material in which at least one set of four sets of physical constants changes in response to a root-mean-square value of voltage applied to the material, the four sets of physical constants being (1) transmittivity of light; (2) reflectance of light; (3) polarization factor of light; and (4) spectrum distribution of transmittivity, reflectance, and polarization factor including light color.

Use of the driving method for gradation display according to the present invention in a display apparatus of simple matrix type shortens the minimum time interval of the driving pulse waveform, reduces the frequency band in use and hence reduces crosstalk, as compared with the conventional technique. As a result, false image and flicker on the displayed picture can be suppressed.

We claim:

1. In a display apparatus for causing a change in physical constant of a material according to a potential difference at a matrix intersection by (1) forming a matrix having wires arranged longitudinally and laterally, (2) applying voltages respectively to a longitudinal wire and a lateral wire to form a potential difference at a matrix intersection, (3) using a material, at least one set among four sets of physical constants of said material changing in response to a root-mean-square value of voltage applied to said material, said four sets being (3-1) transmittivity of light, (3-2) reflectance of light, (3-3) polarization factor of light, and (3-4) spectrum distribution of transmittivity, reflectance, and polarization factor including light color, and (4) applying said potential difference at the matrix intersection to said material, a display apparatus driving method comprising the steps of:

(5) supplying a gradation level to be displayed on the basis of n-bit display data, n being an integer, said n-bit display data being constituted by n bits and thereby having a length of n bits;

(6) on the basis of said length of n bits of said n-bit display data, (6-1) dividing one frame interval into n equal parts, said n equal parts being equal in number to said length of n bits of said n-bit display data, or (6-2) dividing one horizontal interval into n equal parts, said n equal parts being equal in number to said length of n bits of said n-bit display data, or (6-3) conducting time division so that temporal interchange in one frame interval may produce an equivalent of said n equal parts, said n equal parts being equal in number to said length of n bits of said n-bit display data; and (7) on the basis of display data of respective display bits, controlling the voltage supplied to said matrix.

2. A display apparatus driving method according to claim 1, wherein a concrete voltage waveform of said voltage supplied to said matrix in said (7) is determined on the basis of equations:

$$Y(j,k,t) = a(k) \cdot \phi(j,k,t) \quad \text{(eq. 11)}$$

$$X(i,k,t) = b(k) \cdot \sum_{j=1}^{M} I(i,j,k) \cdot \phi(j,k,t) \quad \text{(eq. 12)}$$

where i and j indicate the order in said matrix;

k is the bit order of said n-bit display data;

t represents time counted for each of noticed display bits;

Y(j,k,t) means a voltage waveform generated by a jth Y driving circuit at time t of a kth bit, and said Y(j,k,t) is a voltage waveform applied to a jth row of said matrix;

X(i,k,t) means a voltage waveform generated by an ith X driving circuit at time t of a kth bit, and said X(i,k,t) is a voltage waveform applied to an ith row of said matrix;

a(k) and b(k) are parameters depending upon a kth bit;

I(i,j,k) is a value based upon display data, and I(i,j,k) is −1 in case an ith row of a jth column of said matrix is to be provided with density of a kth bit, and I(i,j,k) is 1 in case the ith row of the jth column of said matrix is to be not provided with the density of the kth bit;

M is an integer; and $\phi(j,k,t)$ is an orthogonal function having a constant norm, i.e., $$\int dt\,\phi(i,k,t)\phi(j,k,t)=0 \quad i\neq j$$

$$\int dt\,\phi(i,k,t)\phi(j,k,t)=\text{constant} \quad i=j$$

where the integration range covers the whole of time assigned to a noticed bit in one frame interval.

3. A display apparatus driving method according to claim 2, wherein values of said parameters a(k) and b(k) are determined so that product of a(k) and b(k) may have a desired value.

4. A display apparatus driving method according to claim 3, wherein the product of a(k) and b(k) has a value expressed as $$a(k)\cdot b(k)=\text{consts } 2/2^{**}(k-1)$$

where consts 2 is an arbitrary constant; and

2**(k−1) means a (k−1)th power of 2, and k means a kth bit representing a density gradation level.

5. A display apparatus driving method according to claim 4, wherein a ratio of values of said parameters a(k) and b(k) is made equal to:

a ratio for maximizing a dynamic range of a root-mean-square value of voltage in one frame interval; or a ratio which is substantially equal, in practical use, to said ratio for maximizing the dynamic range.

6. A display apparatus driving method according to claim 3, wherein a ratio of values of said parameters a(k) and b(k) is made equal to:

a ratio for maximizing a dynamic range of a root-mean-square value of voltage in one frame interval; or a ratio which is substantially equal, in practical use, to said ratio for maximizing the dynamic range.

7. A display apparatus driving method according to claim 1, wherein liquid crystal is used as said material.

8. In a display apparatus for causing a change in physical constant of a material according to a potential difference at a matrix intersection by (1) forming a matrix having wires arranged longitudinally and laterally, (2) applying voltages respectively to a longitudinal wire and a lateral wire to form a potential difference at a matrix intersection, (3) using a material, at least one set among four sets of physical constants of said material changing in response to a root-mean-square value of voltage applied to said material, said four sets being (3-1) transmittivity of light, (3-2) reflectance of light, (3-3) polarization factor of light, and (3-4) spectrum distribution of transmittivity, reflectance, and polarization factor including light color, and (4) applying said potential difference at the matrix intersection to said material, a display apparatus driving method comprising the steps of:

(5) supplying a gradation level to be displayed on the basis of n-bit display data, n being an integer, said n-bit display data being constituted by n bits and thereby having a length of n bits;

(6) in order to divide time and establish independent sections, (6-1) dividing one frame interval into n equal parts, said n equal parts being equal in number to said length of n bits of said n-bit display data, or (6-2) dividing one horizontal interval into n equal parts, said n equal parts being equal in number to said length of n bits of said n-bit display data, or (6-3) conducting time division so that temporal interchange in one frame interval may produce an equivalent of said n equal parts, said n equal parts being equal in number to said length of n bits of said n-bit display data, (6-4) associating said n time-division sections with driving bit trains used for driving said sections, respectively, (6-5) determining a voltage value applied to said matrix for each of said n time-division sections and providing said n sections with respective root-mean-square voltage values, (6-6) selecting said applied voltage value so that a combination of root-mean-square voltage values produced by said n sections may implement a desired display luminance based upon said display data, (6-7) associating said display data with said driving bit trains on the basis of the order of values of said combined root-mean-square voltage values, and (6-8) generating said driving bit train from said display data on the basis of said association; and (7) on the basis of said driving bit train, controlling the voltage supplied to said matrix where n and 1 are integers.

9. In a display apparatus for causing a change in physical constant of a material according to a potential difference at a matrix intersection by:

(1) forming a matrix having wires arranged longitudinally and laterally;

(2) applying voltages respectively to a longitudinal wire and a lateral wire to form a potential difference at a matrix intersection;

(3) using a material, at least one set among four sets of physical constants of said material changing in response to a root-mean-square value of voltage applied to said material, said four sets being (3-1) transmittivity of light;

(3-2) reflectance of light;

(3-3) polarization factor of light;

(3-4) spectrum distribution of transmittivity, reflectance, and polarization factor including light color; and (4) applying said potential difference at the matrix intersection to said material, a display apparatus driving method comprising the steps of:

(5) supplying a gradation level to be displayed, on the basis of n-bit display data;

(6) on the basis of said number of gradation display bits n, (6-1) dividing one frame interval into n parts;

(6-2) dividing one horizontal interval into n parts; or (6-3) conducting time division so that temporal interchange in one frame interval may produce an equivalent of said n parts; and (7) on the basis of display data of respective display bits, determining the voltage supplied to said matrix by using $$Y(j,k,t) = a(k) \cdot \phi(j,k,t)$$

$$X(i,k,t) = b(k) \cdot \sum_{j=1}^{M} I(i,j,k) \cdot \phi(j,k,t)$$

where i and j indicate the order in said matrix;

k is the bit order of said n-bit display data;

t represents time counted for each of noticed display bits;

Y(j,k,t) means a voltage waveform generated by a jth Y driving circuit at time t of a kth bit, and said Y(j,k,t) is a voltage waveform applied to a jth row of said matrix;

X(i,k,t) means a voltage waveform generated by an ith X driving circuit at time t of a kth bit, and said X(i,k,t) is a voltage waveform applied to an ith row of said matrix;

a(k) and b(k) are parameter values, at least one of said parameter values depending upon k;

I(i,j,k) is a value based upon display data, and I(i,j,k) is −1 in case an ith row of a jth column of said matrix is to be provided with density of a kth bit, and I(i,j,k) is 1 in case the ith row of the jth column of said matrix is to be not provided with the density of the kth bit; and ϕ(j,k,t) is an orthogonal function having a constant norm, i.e., $$\int dt\phi(i,k,t)\phi(j,k,t)=0 \neq j$$

$$\int dt\phi(i,k,t)\phi(j,k,t)=\text{constant } i=j$$

where the integration range covers the whole of time assigned to a noticed bit in one frame interval;

where n is an integer.

10. A display apparatus driving method according to claim 9, wherein in case said applied voltage cannot be applied because a permissible range is exceeded, a time interval of said time division and an applied voltage value are set so that application time may be lengthened by an amount corresponding to suppression to applicable voltage value.

11. In a display apparatus for causing a change in physical constant of a material according to a potential difference at a matrix intersection by:

(1) forming a matrix having wires arranged longitudinally and laterally;

(2) applying voltages respectively to a longitudinal wire and a lateral wire to form a potential difference at a matrix intersection;

(3) using a material, at least one set among four sets of physical constants of said material changing in response to a root-mean-square value of voltage applied to said material, said four sets being (3-1) transmittivity of light;

(3-2) reflectance of light;

(3-3) polarization factor of light;

(3-4) spectrum distribution of transmittivity, reflectance, and polarization factor including light color; and (4) applying said potential difference at the matrix intersection to said material, a display apparatus driving method comprising the steps of:

(5) supplying a gradation level to be displayed, on the basis of n-bit display data;

(6) in order to divide time and establish independent sections, (6-1) dividing one frame interval into r parts, r being at least n;

(6-2) dividing one horizontal interval into r parts; or (6-3) conducting time division so that temporal interchange in one frame interval may produce an equivalent of said r parts; and (7) on the basis of display data, determining the voltage supplied to said matrix by using $$Y(j,g,t)=a(g)\cdot\phi(j,g,t)$$

where $$X(i,g,t)=b(g)\cdot\sum_{j=1}^{M} I(i,j,g)\cdot\phi(j,g,t)$$

i and j indicate the order in said matrix;

g is an order assigned to each of sections obtained by dividing time into r parts, said g being an integer ranging from 1 to r;

t represents time counted for each of noticed divisional section;

Y(j,g,t) means a voltage waveform generated by a jth Y driving circuit at gth time t, and said Y(j,g,t) is a voltage waveform applied to a jth row of said matrix;

X(i,g,t) means a voltage waveform generated by an ith X driving circuit at gth time t, and said X(i,g,t) is a voltage waveform applied to an ith row of said matrix;

a(g) and b(g) are parameter values, at least one of said parameter values depending upon g;

J(i,j,g) is a value based upon display data of an ith row of a jth column in said matrix, and J(i,j,g) is −1 in case a matrix intersection of the ith row of the jth column of said matrix is to be provided with a high root-mean-square voltage value in a gth time-division section, and J(i,j,g) is 1 in case a matrix intersection of the ith row of the jth column of said matrix is to be provided with a low root-mean-square voltage value; and ϕ(j,g,t) is an orthogonal function having a constant norm, i.e., $$\int dt\phi(i,g,t)\phi(j,g,t)=0 \neq j$$

$$\int dt\phi(i,g,t)\phi(j,g,t)=\text{constant } i=j$$

where the integration range covers the whole of the noticed gth time-division section in one frame interval;

where n and m are integers.

12. A display apparatus driving method according to claim 11, wherein a time interval and an applied voltage value are set so that said time division may produce equal divisions as far as possible.

13. A display apparatus driving method according to claim 11, wherein in case said applied voltage cannot be applied because a permissible range is exceeded, a time interval of said time division and an applied voltage value are set so that application time may be lengthened by an amount corresponding to suppression to applicable voltage value.

14. A display apparatus driving method for driving a matrix type liquid crystal display device having a matrix electrode set consisting of N column electrodes, N being an integer, and M row electrodes, M being an integer, and a liquid crystal layer which assumes a structural change causing a matrix intersection of said display device to generate a gray level value of a voltage applied between a respective column electrode and a respective row electrode forming said matrix intersection, said driving method comprising the steps of:

applying line-to-line scanning signals synchronized with a frame interval to said row electrodes, respectively; and applying pixel driving signals to said column electrodes, respectively, the waveform of each of said pixel driving signals corresponding to a gray level to be displayed at each matrix intersection, said gray level being expressed by an n-bit binary code, n being an integer, said n-bit binary code being constituted by n bits and thereby having a length of n bits;

wherein waveforms of said line-to-line scanning signals and pixel driving signals are formed by dividing one frame interval into n equal periods and dividing each of said n equal periods into M equal sub-periods, said n equal periods being equal in number to said length of n bits of said n-bit binary code, or dividing one horizontal interval divided from said one frame interval into n equal sub-periods, said n equal sub-periods being equal in number to said length of n bits of said n-bit binary code; and wherein said driving method further comprises the step of, on the basis of display data of respective bits of said n-bit binary code, controlling the voltage supplied to said matrix electrode set.

15. A display apparatus driving method according to claim 14, wherein said voltage supplied to said matrix electrode is nonlinearly varied corresponding to each of bits of said n-bit binary code.

16. A display apparatus driving method according to claim 14, wherein a ratio of voltage supplied to said N column electrode and M row electrode is determined based on a dynamic range of said gray level value.

17. A display apparatus driving method according to claim 14, wherein when said voltage supplied to said matrix electrode set is greater than a predetermined value, said n equal periods or n equal sub-periods become n nonequal periods or n nonequal sub-periods.

* * * * *